US011302245B2

(12) United States Patent
Xuan et al.

(10) Patent No.: US 11,302,245 B2
(45) Date of Patent: Apr. 12, 2022

(54) PIXEL CIRCUIT, DRIVING METHOD THEREOF, AND DISPLAY DEVICE

(71) Applicant: BOE Technology Group Co., Ltd., Beijing (CN)

(72) Inventors: Minghua Xuan, Beijing (CN); Xiaochuan Chen, Beijing (CN); Han Yue, Beijing (CN); Ning Cong, Beijing (CN); Dongni Liu, Beijing (CN); Qi Qi, Beijing (CN); Jing Liu, Beijing (CN)

(73) Assignee: BOE Technology Group Co., Ltd., Beijing (CN)

( * ) Notice: Subject to any disclaimer, the term of this patent is extended or adjusted under 35 U.S.C. 154(b) by 0 days.

(21) Appl. No.: 16/894,902

(22) Filed: Jun. 8, 2020

(65) Prior Publication Data

US 2021/0193022 A1 Jun. 24, 2021

(30) Foreign Application Priority Data

Dec. 19, 2019 (CN) ..... 201911317280.8

(51) Int. Cl.
*G09G 3/30* (2006.01)
*G09G 3/32* (2016.01)

(52) U.S. Cl.
CPC ..... *G09G 3/32* (2013.01); *G09G 2300/0852* (2013.01); *G09G 2310/0267* (2013.01); *G09G 2310/0275* (2013.01)

(58) Field of Classification Search
CPC ..... G09G 3/32; G09G 2300/0852; G09G 2310/0267; G09G 2310/0275; G09G 3/3266; G09G 2300/0842; G09G 2310/066; G09G 2320/0653; G09G 2330/0228
USPC ..... 345/204, 76, 690
See application file for complete search history.

(56) References Cited

U.S. PATENT DOCUMENTS

2017/0069264 A1* 3/2017 Dai ..... G09G 3/3233
2017/0193910 A1* 7/2017 Chen ..... G09G 3/325
2020/0074919 A1* 3/2020 Hung ..... G09G 3/32
2021/0110770 A1* 4/2021 Yang ..... G09G 3/3233

FOREIGN PATENT DOCUMENTS

CN 105185304 A 12/2015
CN 108510946 A 9/2018
CN 109272936 A 1/2019
(Continued)

OTHER PUBLICATIONS

Office Action dated Nov. 3, 2021 for Chinese Patent Application No. 201911317280.8 and English Translation.

*Primary Examiner* — Jennifer T Nguyen
(74) *Attorney, Agent, or Firm* — Ling Wu; Stephen Yang; Ling and Yang Intellectual Property

(57) ABSTRACT

Provided are a pixel circuit, a driving method thereof and a display device. The pixel circuit includes a first charging sub-circuit, a second charging sub-circuit, a first storage sub-circuit, a first switching sub-circuit, a second switching sub-circuit and a light emitting sub-circuit. The first charging sub-circuit is configured to provide a signal of a first data signal terminal to a first node under control of a scanning signal terminal, and after providing the signal of the first data signal terminal, provide a signal of a second data signal terminal to the first node under control of a light emitting control terminal.

18 Claims, 11 Drawing Sheets

(56) References Cited

FOREIGN PATENT DOCUMENTS

| | | | |
|---|---|---|---|
| CN | 110021263 | A | 7/2019 |
| KR | 20090043294 | A | 5/2009 |
| WO | 2020007024 | A1 | 1/2020 |

* cited by examiner

PIXEL CIRCUIT, DRIVING METHOD THEREOF, AND DISPLAY DEVICE

CROSS-REFERENCE TO RELATED APPLICATION

The present application claims the priority of the Chinese Patent Application No. 201911317280.8, filed to the CNIPA on Dec. 19, 2019, the content of which is hereby incorporated by reference.

TECHNICAL FIELD

Embodiments of the disclosure relate to, but are not limited to, the technical field of display, in particular to a pixel circuit, a driving method thereof and a display device.

BACKGROUND

In Micro Light Emitting Diode (Micro LED) technology, micro-sized LED arrays are integrated on a chip in a high density, so as to realize thin-film, miniaturization and matrixing of light emitting diodes. A distance between pixels can reach a micron level, and each pixel can be addressed and emit light independently. A Micro LED display panel has gradually developed into a display panel for a consumer terminal due to its characteristics, such as low driving voltage, long life, wide temperature tolerance.

In some technologies, a pixel circuit is electrically connected with micro light emitting diodes to drive the micro light emitting diodes to emit light. However, the pixel circuit provided in some technologies cannot accurately and effectively control brightness and gray tone of the micro light emitting diodes, and working stability of the micro light emitting diodes is poor, thus greatly reducing the display effect of the display panel.

SUMMARY

The following is a summary of the subject matter described in detail in this document. This summary is not intended to limit the protection scope of the claims.

An embodiment of the disclosure provides a pixel circuit, which includes a first charging sub-circuit, a second charging sub-circuit, a first storage sub-circuit, a first switching sub-circuit, a second switching sub-circuit and a light emitting sub-circuit. The first charging sub-circuit is connected with a first node, a scanning signal terminal, a light emitting control terminal, a first data signal terminal and a second data signal terminal, respectively, and is configured to provide a signal of the first data signal terminal to the first node under control of the scanning signal terminal, and after providing a signal of the first data signal terminal, provide a signal of the second data signal terminal to the first node under control of the light emitting control terminal. The second charging sub-circuit is connected with the scanning signal terminal, a second node and a third node, respectively, and is configured to compensate the second node under the control of the scanning signal terminal. The first storage sub-circuit is connected with a first node and the second node, respectively, and is configured to store an amount of charge between the first node and the second node. The first switching sub-circuit is connected with the second node and the third node, respectively, and is configured to control a potential of the third node under control of the second node. The second switching sub-circuit is connected with the third node, the light emitting control terminal and a fourth node, respectively, and is configured to provide a signal of the third node to the fourth node under control of the light emitting control terminal. One terminal of the light emitting sub-circuit is connected with the fourth node, and the other terminal of the light emitting sub-circuit is connected with a second voltage terminal.

In some possible implementations, the signal of the second data signal terminal is a signal having a time-varying amplitude.

In some possible implementations, the first charging sub-circuit includes a preceding charging sub-circuit and a succeeding charging sub-circuit. The preceding charging sub-circuit includes a first transistor, a control electrode of the first transistor is connected with the scanning signal terminal, a first electrode of the first transistor is connected with the first data signal terminal, and a second electrode of the first transistor is connected with the first node. The succeeding charging sub-circuit includes a second transistor, a control electrode of the second transistor is connected with the light emitting control terminal, a first electrode of the second transistor is connected with the second data signal terminal, and a second electrode of the second transistor is connected with the first node.

In some possible implementations, the light emitting sub-circuit includes a micro light emitting diode or a mini light emitting diode.

In some possible implementations, the second charging sub-circuit includes a third transistor, the first storage sub-circuit includes a first capacitor. A control electrode of the third transistor is connected with the scanning signal terminal, a first electrode of the third transistor is connected with the second node, and a second electrode of the third transistor is connected with the third node. One end of the first capacitor is connected with the first node, and the other end of the first capacitor is connected with the second node.

In some possible implementations, the first switching sub-circuit includes a fourth transistor, the second switching sub-circuit includes a fifth transistor. A control electrode of the fourth transistor is connected with the second node, a first electrode of the fourth transistor is connected with the first voltage terminal, and a second electrode of the fourth transistor is connected with the third node. A control electrode of the fifth transistor is connected with the light emitting control terminal, a first electrode of the fifth transistor is connected with the third node, and a second electrode of the fifth transistor is connected with the fourth node.

In some possible implementations, the pixel circuit further includes a current control sub-circuit, the current control sub-circuit is connected between the fourth node and the light emitting sub-circuit, the current control sub-circuit is connected with the scanning signal terminal, a first voltage terminal and a third data signal terminal, respectively, and is configured to output a preset current to the light emitting sub-circuit under control of the fourth node and the scanning signal terminal.

In some possible implementations, the current control sub-circuit includes a third charging sub-circuit, a second storage sub-circuit, a third switching sub-circuit and a fourth switching sub-circuit. The third charging sub-circuit is connected with a third data signal terminal, the scanning signal terminal and a fifth node, respectively, and is configured to provide a signal of the third data signal terminal to the fifth node under the control of the scanning signal terminal. The second storage sub-circuit is connected with the fifth node and the first voltage terminal, respectively, and is configured to store an amount of charge between the fifth node and the first voltage terminal. The third switching sub-circuit is connected with the fifth node, the first voltage terminal and a sixth node, respectively, and is configured to provide a signal of the first voltage terminal to the sixth node under control of the fifth node. The fourth switching sub-circuit is connected with the sixth node, one terminal of the light emitting sub-circuit and the fourth node, respectively, and is configured to provide a signal of the sixth node to the light emitting sub-circuit under control of the fourth node.

In some possible implementations, the third charging sub-circuit includes a sixth transistor, the second storage sub-circuit includes a second capacitor, the third switching sub-circuit includes a seventh transistor, and the fourth switching sub-circuit includes an eighth transistor. A control electrode of the sixth transistor is connected with the scanning signal terminal, a first electrode of the sixth transistor is connected with the third data signal terminal, and a second electrode of the sixth transistor is connected with the fifth node. One end of the second capacitor is connected with the fifth node, and the other end of the second capacitor is connected with the first voltage terminal. A control electrode of the seventh transistor is connected with the fifth node, a first electrode of the seventh transistor is connected with the first voltage terminal, and a second electrode of the seventh transistor is connected with the sixth node. A control electrode of the eighth transistor is connected with the fourth node, a first electrode of the eighth transistor is connected to the sixth node, and a second electrode of the eighth transistor is connected with one terminal of the light emitting sub-circuit.

In some possible implementations, the current control sub-circuit includes a first reset sub-circuit, a fourth charging sub-circuit, a third storage sub-circuit, a first compensation sub-circuit, a first driving sub-circuit and a fourth switching sub-circuit. The first reset sub-circuit is connected with a reset control signal terminal, a reset voltage terminal and a seventh node, respectively, and is configured to write a signal of the reset voltage terminal into the seventh node under the control of the reset control signal terminal. The fourth charging sub-circuit is connected with the scanning signal terminal, a third data signal terminal and an eighth node, respectively, and is configured to provide a signal of the third data signal terminal to the eighth node under the control of the scanning signal terminal. The third storage sub-circuit is connected with a seventh node and an eighth node, respectively, and is configured to store an amount of charge between the seventh node and the eighth node. The first compensation sub-circuit is connected with the scanning signal terminal, the sixth node and the seventh node, respectively, and is configured to compensate a voltage of the seventh node under the control of the scanning signal terminal. The first driving sub-circuit is connected with the sixth node, the seventh node and the first voltage terminal, respectively, and is configured to generate a driving current according to the voltage of the first voltage terminal and output the driving current to the sixth node under control of the seventh node. The fourth switching sub-circuit is connected with the sixth node, one terminal of the light emitting sub-circuit and the fourth node, respectively, and is configured to provide a signal of the sixth node to the light emitting sub-circuit under control of the fourth node.

In some possible implementations, the fourth switching sub-circuit includes an eighth transistor, the first reset sub-circuit includes a ninth transistor, the fourth charging sub-circuit includes a tenth transistor, an eleventh transistor, and a twelfth transistor, the third storage sub-circuit includes a third capacitor, the first compensation sub-circuit includes a thirteenth transistor, the first driving sub-circuit includes a fourteenth transistor. A control electrode of the eighth transistor is connected with the fourth node, a first electrode of the eighth transistor is connected to the sixth node, and a second electrode of the eighth transistor is connected with a terminal of the light emitting sub-circuit. A control electrode of the ninth transistor is connected with the reset control signal terminal, a first electrode of the ninth transistor is connected with the reset voltage terminal, and a second electrode of the ninth transistor is connected with the seventh node. A control electrode of the tenth transistor is connected with the scanning signal terminal, a first electrode of the tenth transistor is connected with the third data signal terminal, and a second electrode of the tenth transistor is connected with the eighth node. A control electrode of the eleventh transistor is connected with the light emitting control terminal, a first electrode of the eleventh transistor is connected with the second voltage terminal, and a second electrode of the eleventh transistor is connected with the eighth node. A control electrode of the twelfth transistor is connected with the reset control signal terminal, a first electrode of the twelfth transistor is connected with the second voltage terminal, and a second electrode of the twelfth transistor is connected with the eighth node. One end of the third capacitor is connected with the seventh node, and the other end of the third capacitor is connected with the eighth node. A control electrode of the thirteenth transistor is connected with the scanning signal terminal, a first electrode of the thirteenth transistor is connected with the sixth node, and a second electrode of the thirteenth transistor is connected with the seventh node. A control electrode of the fourteenth transistor is connected with the seventh node, a first electrode of the fourteenth transistor is connected with the first voltage terminal, and a second electrode of the fourteenth transistor is connected with the sixth node.

In some possible implementations, the current control sub-circuit includes a second reset sub-circuit, a third reset sub-circuit, a light emitting control sub-circuit, a fifth charging sub-circuit, a fourth storage sub-circuit, a second compensation sub-circuit, a second driving sub-circuit, and a fourth switching sub-circuit. The second reset sub-circuit is connected with a reset control signal terminal, a reset voltage terminal, and a ninth node, respectively, and is configured to write a signal of the reset voltage terminal to the ninth node under control of the reset control signal terminal. The third reset sub-circuit is connected with the scanning signal terminal, the reset voltage terminal and one terminal of the light emitting sub-circuit, respectively, and is configured to write the signal of the reset voltage terminal into the light emitting sub-circuit under the control of the scanning signal terminal. The light emitting control sub-circuit is connected with the light emitting control terminal, a first voltage terminal and a tenth node, respectively, and is configured to provide a signal of the first voltage terminal to the tenth node under the control of the light emitting control terminal. The fifth charging sub-circuit is connected with the scanning signal terminal, the third data signal terminal and the tenth node, respectively, and is configured to provide a signal of the third data signal terminal to the tenth node under the control of the scanning signal terminal. The fourth storage sub-circuit is connected with the ninth node and the first voltage terminal, respectively, and is configured to store an amount of charge between the ninth node and the first voltage terminal. The second compensation sub-circuit is connected with the scanning signal terminal, the sixth node and the ninth node, respectively, and is configured to compensate a voltage of the ninth node under the control of the scanning signal terminal. The second driving sub-circuit is connected with the sixth node, the ninth node and the tenth node, respectively, and is configured to generate a driving current according to the voltage of the tenth node and output the driving current to the sixth node under control of the ninth node. The fourth switching sub-circuit is connected with a sixth node, one terminal of the light emitting sub-circuit and the fourth node, respectively, and is configured to provide a signal of the sixth node to the light emitting sub-circuit under control of the fourth node.

In some possible implementations, the fourth switching sub-circuit includes an eighth transistor, the second reset sub-circuit includes a fifteenth transistor, the third reset sub-circuit includes a sixteenth transistor, the fifth charging sub-circuit includes a seventeenth transistor, the fourth storage sub-circuit includes a fourth capacitor, the second compensation sub-circuit includes an eighteenth transistor, the second driving sub-circuit includes a nineteenth transistor, the light emitting control sub-circuit includes a twentieth transistor. A control electrode of the eighth transistor is connected with the fourth node, a first electrode of the eighth transistor is connected with the six nodes, and a second electrode of the eighth transistor is connected with one terminal of the light emitting sub-circuit. A control electrode of the fifteenth transistor is connected with the scanning signal terminal, a first electrode of the fifteenth transistor is connected with the reset voltage terminal, and a second electrode of the fifteenth transistor is connected with one terminal of the light emitting sub-circuit. A control electrode of the sixteenth transistor is connected with the reset control signal terminal, a first electrode of the sixteenth transistor is connected with the reset voltage terminal, and a second electrode of the sixteenth transistor is connected with the ninth node. A control electrode of the seventeenth transistor is connected with the scanning signal terminal, a first electrode of the seventeenth transistor is connected with the third data signal terminal, and a second electrode of the seventeenth transistor is connected with the tenth node. A control electrode of the eighteenth transistor is connected with the scanning signal terminal, a first electrode of the eighteenth transistor is connected with the sixth node, and a second electrode of the eighteenth transistor is connected with the ninth node. A control electrode of the nineteenth transistor is connected with the ninth node, a first electrode of the nineteenth transistor is connected with the tenth node, and a second electrode of the nineteenth transistor is connected with the sixth node. A control electrode of the twentieth transistor is connected with the light emitting control terminal, a first electrode of the twentieth transistor is connected with the first voltage terminal, and a second electrode of the twentieth transistor is connected with the tenth node. One end of the fourth capacitor is connected with the first voltage terminal, and the other end of the fourth capacitor is connected with the ninth node.

An embodiment of the present disclosure further provides a display device including the pixel circuit described above.

An embodiment of the disclosure also provides a driving method of the pixel circuit, for driving the pixel circuit described above, wherein the pixel circuit has multiple scanning periods; and in one scanning period, the driving method includes: providing a first voltage to a first voltage terminal, providing a scanning signal to a scanning signal terminal, providing a first data voltage to the first data signal terminal, writing the first data voltage to a first node through a first charging sub-circuit, and compensating the second node by a second charging sub-circuit the control of the scanning signal terminal; providing a light emitting control signal to a light emitting control terminal and providing a second data voltage to a second data signal terminal, writing the second data voltage to the first node through the first charging sub-circuit, and a voltage of the second node jumping along with a voltage of the first node to control a first switching sub-circuit to be turned on or off, and emitting light by a light emitting sub-circuit under control of the first switching sub-circuit and a second switching sub-circuit.

In some possible implementations, before the light emitting control signal is provided to the light emitting control terminal, the driving method further includes: providing a third data voltage to a third data signal terminal, and generating a driving current with a preset current density by a current control sub-circuit based on the first voltage and the third data voltage under control of the scanning signal terminal.

Other aspects will become apparent upon reading and understanding the brief description of the drawings and embodiments of the present disclosure.

BRIEF DESCRIPTION OF DRAWINGS

Accompanying drawings are used for providing a further understanding of technical solutions of the present disclosure and form a part of the specification. Together with embodiments of the present disclosure, the accompanying drawings are used for explaining technical solutions of the embodiments of the present disclosure and do not constitute a limitation on the technical solutions of the embodiments of the present disclosure.

ILLUSTRATION OF THE REFERENCE SIGNS

Gate—scanning signal terminal; EM—light emitting control terminal;

RST—reset control signal terminal; Vini—reset voltage terminal;

Vdata1—first data signal terminal; Vdata2—second data signal terminal;

Vdata3—third data signal terminal; VDD—first voltage terminal;

VSS—second voltage terminal; Vref—third voltage terminal;

L—Light Emitting Element; C1~C4—Capacitors;

M1~M20—Transistors; N1~N10—Nodes.

DETAILED DESCRIPTION

In order to make the objects, technical solutions and advantages of the present disclosure more clear, embodiments of the present disclosure will be described in detail below with reference to the accompanying drawings. Without a conflict, the embodiments in the present disclosure and the features in the embodiments may be combined with each other arbitrarily.

Unless otherwise defined, technical terms or scientific terms used and disclosed in the embodiments of the disclosure shall possess the general meaning understood by those with general skills in the field to which the disclosure pertains. The words "first", "second" and the like used in the embodiments of the present disclosure do not indicate any order, quantity or importance, but are only used for distinguishing different components. Similar words such as "comprising" or "including" mean that the elements or articles preceding the word cover elements or articles listed after the word and their equivalents, and do not exclude other elements or articles.

Those skilled in the art can understand that transistors used in the embodiments of the present disclosure may be thin film transistors or field effect transistors or other devices with same characteristics. The thin film transistor used in the embodiments of the present disclosure may be an oxide semiconductor transistor. Since a source and a drain of a transistor used here are symmetrical, the source and the drain may be interchanged. In the embodiments of the present disclosure, to distinguish the two electrodes of the transistor except a gate, one of the electrodes is referred to as a first electrode and the other electrode is referred to as a second electrode. The first electrode may be a source or a drain, and the second electrode may be a drain or a source.

An embodiment of the present disclosure provides a pixel circuit configured to control a conduction time length of a current path between a first voltage terminal and a second voltage terminal. When the current path is conducted, a first voltage output from the first voltage terminal and a second voltage output from the second voltage terminal may provide a potential difference to the current path.

In this embodiment, the first voltage output from the first voltage terminal VDD may be a constant high level, and the second voltage output from the second voltage terminal VSS may be a constant low level.

Figure 1:
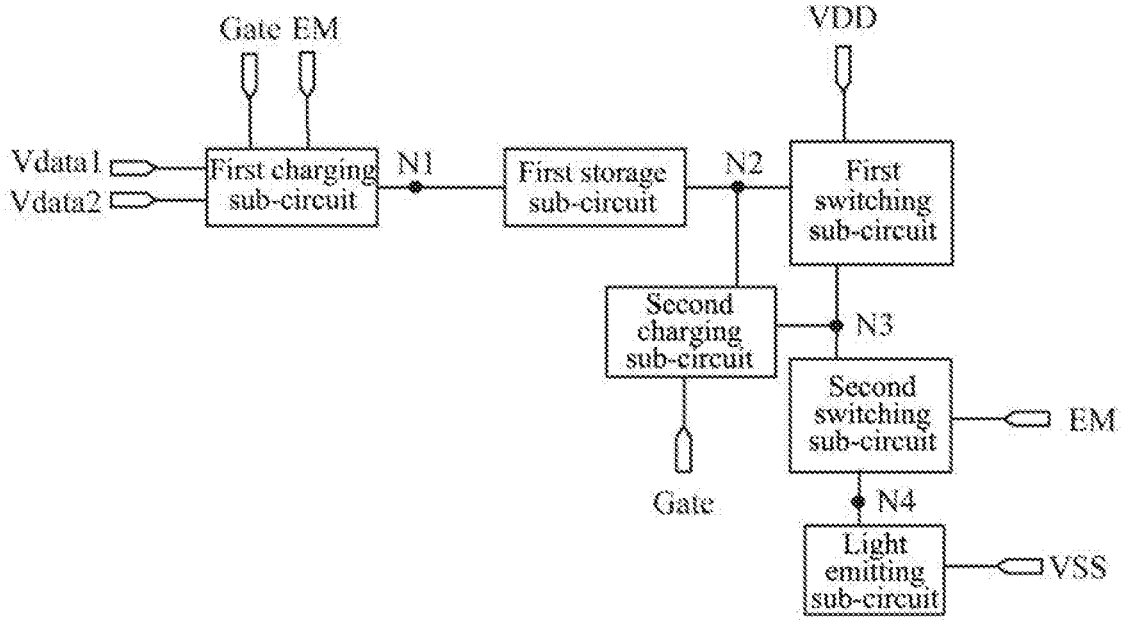
FIG. 1 is a first structural diagram of a pixel circuit according to an embodiment of the present disclosure.

FIG. 1 is a first structural schematic diagram of a pixel circuit provided by an embodiment of the disclosure. As shown in FIG. 1, the pixel circuit includes a first charging sub-circuit, a second charging sub-circuit, a first storage sub-circuit, a first switching sub-circuit, a second switching sub-circuit and a light emitting sub-circuit.

In an exemplary embodiment, the light emitting sub-circuit includes a light emitting element L which may be a Micro Light Emitting Diode (LED) or a Mini LED. The Micro LED is micron-sized.

The first charging sub-circuit is connected with a first node N1, a scanning signal terminal Gate, a light emitting control terminal EM, a first data signal terminal Vdata1 and a second data signal terminal Vdata2, respectively. The first charging sub-circuit is configured to provide a signal of the first data signal terminal Vdata1 to the first node N1 under control of the scanning signal terminal Gate, and after providing the signal of the first data terminal Vdata1, to provide a signal of the second data signal terminal Vdata2 to the first node N1 under control of the light emitting control terminal EM.

The second charging sub-circuit is connected with the scanning signal terminal Gate, a second node N2 (i.e., a control terminal of the first switching sub-circuit) and a third node N3 (i.e., a second terminal of the first switching sub-circuit), respectively. The second charging sub-circuit is configured to compensate the second node N2 under control of the scanning signal terminal Gate. For example, a control terminal of the second charging sub-circuit is connected with the scanning signal terminal Gate, a first terminal of the second charging sub-circuit is connected with the second node N2, and a second terminal of the second charging sub-circuit is connected with the third node N3. A signal from the scanning signal terminal Gate is applied to the second charging sub-circuit to control whether the second charging sub-circuit is turned on or not. The second charging sub-circuit may be turned on in response to the signal of the scanning signal terminal Gate, and electrically connect the second node N2 and the third node N3, so that relevant information (threshold voltage information) of a threshold voltage Vth of the first switching sub-circuit and the signal of the first voltage terminal VDD written through the first switching sub-circuit are stored in the second node N2 together, thereby the first switching sub-circuit can be controlled with the stored voltage value including the signal of the first voltage terminal VDD and the threshold voltage information, so that output of the first switching sub-circuit is compensated.

The first storage sub-circuit is connected with the first node N1 and the second node N2, respectively, and is configured to store an amount of charge between the first node N1 and the second node N2.

The first switching sub-circuit is connected with the first voltage terminal VDD, the second node N2 and the third node N3, respectively, and is configured to provide a signal of the first voltage terminal VDD to the third node N3 under control of the second node N2. For example, a control terminal of the first switching sub-circuit is connected with the second node N2, a first terminal of the first switching sub-circuit is connected with the first voltage terminal VDD, and a second terminal of the first switching sub-circuit is connected with the third node N3.

The second switching sub-circuit is connected with the third node N3, the light emitting control terminal EM and a fourth node N4 (i.e., an anode of the light emitting element L), respectively, and is configured to apply a signal of the third node N3 to the anode of the light emitting element L under control of the light emitting control terminal EM. A cathode of the light emitting element L is connected with the second voltage terminal VSS. For example, a control terminal of the second switching sub-circuit is connected with the light emitting control terminal EM, a first terminal of the second switching sub-circuit is connected with the third node N3, and a second terminal of the second switching sub-circuit is connected with the fourth node N4. For example, the second switching sub-circuit may be turned on in response to a signal of the light emitting control terminal EM, so that the signal of the third node may be applied to the fourth node N4 to provide a driving voltage, to drive the light emitting element L to emit light.

According to the pixel circuit provided by an embodiment of the present disclosure, the first charging sub-circuit provides a signal of the first data signal terminal Vdata1 to the first node N1 under the control of the scanning signal terminal Gate, and after providing the signal of the first data signal terminal Vdata1, the first charging sub-circuit provides a signal of the second data signal terminal Vdata2 to the first node N1 under the control of the light emitting control terminal EM. The second charging sub-circuit compensates the second node N2 under the control of the scanning signal terminal Gate. The first storage sub-circuit stores an amount of charge between the first node N1 and the second node N2. The first switching sub-circuit provides a signal of the first voltage terminal VDD to the third node N3 under control of the second node N2. The second switching sub-circuit provides a signal of the third node N3 to the fourth node N4 under the control of the light emitting control terminal EM. Therefore, by adopting the pixel circuit provided by an embodiment of the present disclosure, a situation in which variation of the threshold voltage of the first switching sub-circuit during the display process affects the light emitting brightness of the light emitting element L is avoided, thereby beneficial for remaining the light emitting brightness of the light emitting element L stable during the display process, and further beneficial for improving the display effect. In addition, the pixel circuit provided by an embodiment of the present disclosure may be manufactured on a glass substrate or a transparent resin substrate in a display panel of a display device through a patterning process. When the light emitting element L is a micro light emitting diode, an implementation of a micro LED display device with lower cost, simple manufacturing process and mass production can be provided. The pixel circuit provided by an embodiment of the disclosure is not limited by the number of resolution scanning lines, and is more suitable for high-resolution products.

In an exemplary embodiment, a signal of the second data signal terminal Vdata2 is a voltage signal having a time-varying amplitude.

In an exemplary embodiment, the signal of the second data signal terminal Vdata2 may be a triangular wave signal, a sine signal, or a cosine signal.

According to the pixel circuit provided by an embodiment of the present disclosure, the signal of the second data signal terminal Vdata2 is set as a voltage signal having a time-varying amplitude, thereby a potential of the first node N1 varies with time, and a potential of the second node N2 varies along with the potential of the first node N1 with time, so that the first switching sub-circuit is controlled to be turned on or off with time, and a light emitting time length of the light emitting element L is controlled accordingly. Since the light emitting time length affects an effective brightness of the light emitting element L, in this way, the effective brightness of the light emitting element L can be controlled through a size of the signal of the second data signal terminal Vdata2 in one scanning period, thus achieving a purpose of adjusting a display gray tone.

Figure 2:
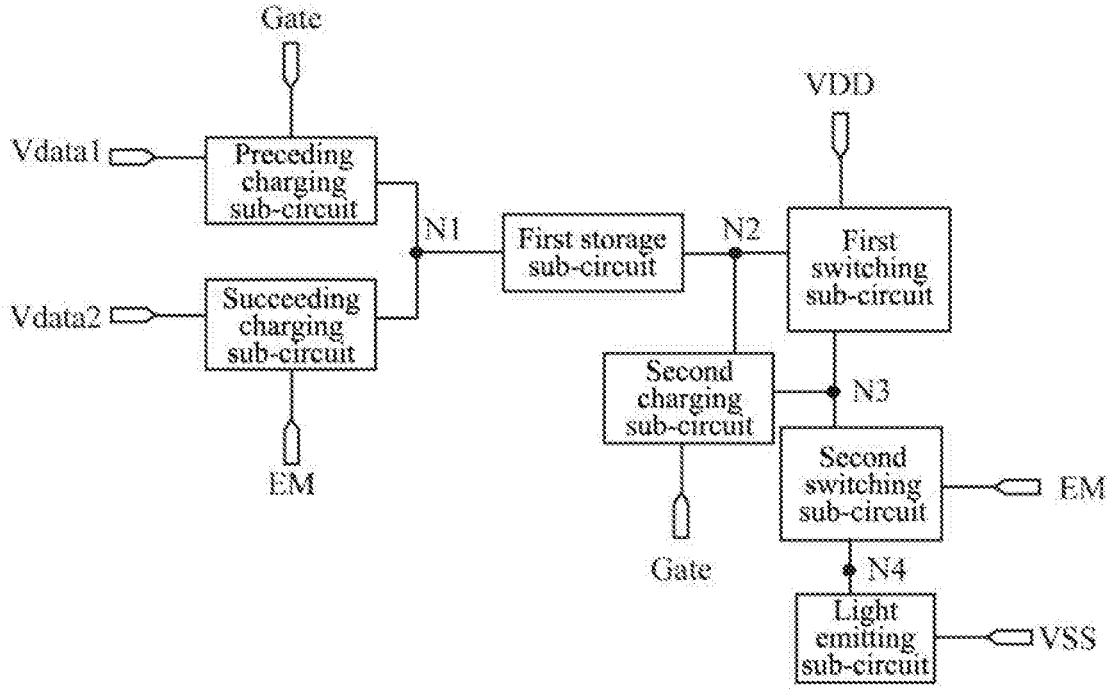
FIG. 2 is a second structural diagram of a pixel circuit according to an embodiment of the present disclosure.

FIG. 2 is a second structural schematic diagram of a pixel circuit according to an embodiment of the disclosure. As shown in FIG. 2, in an exemplary embodiment, a first charging sub-circuit includes a preceding charging sub-circuit and a succeeding charging sub-circuit.

The preceding charging sub-circuit is connected with a first node N1, a scanning signal terminal Gate and a first data signal terminal Vdata1, respectively, and is configured to provide a signal of the first data signal terminal Vdata1 to the first node N1 under control of the scanning signal terminal Gate.

The succeeding charging sub-circuit is connected with the first node N1, a light emitting control terminal EM and a second data signal terminal Vdata2, respectively, and is configured to provide a signal of the second data signal terminal Vdata2 to the first node N1 under control of the light emitting control terminal EM after the signal of the first data signal terminal Vdata1 is provided.

Figure 3:
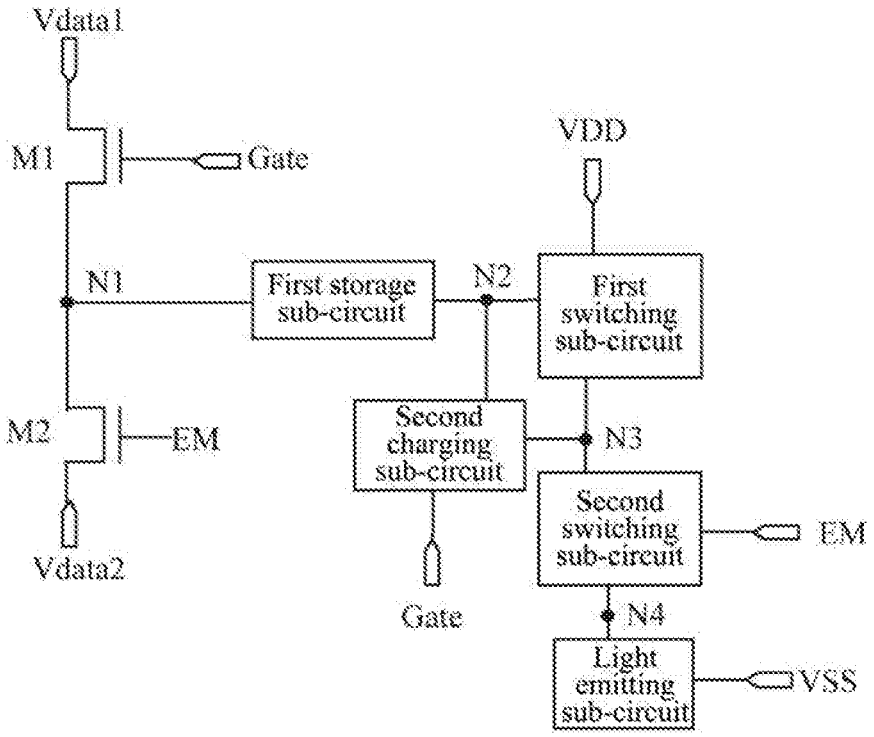
FIG. 3 is an equivalent circuit diagram of a preceding charging sub-circuit and a succeeding charging sub-circuit according to an embodiment of the present disclosure.

FIG. 3 is an equivalent circuit diagram of the preceding charging sub-circuit and the succeeding charging sub-circuit provided by an embodiment of the disclosure. As shown in FIG. 3, in an exemplary embodiment, the preceding charging sub-circuit provided by the embodiment of the disclosure includes a first transistor M1 and the succeeding charging sub-circuit provided by the embodiment of the disclosure includes a second transistor M2.

A control electrode of the first transistor M1 is connected with the scanning signal terminal Gate, a first electrode of the first transistor M1 is connected with the first data signal terminal Vdata1, and a second electrode of the first transistor M1 is connected with the first node N1.

A control electrode of the second transistor M2 is connected with the light emitting control terminal EM, a first electrode of the second transistor M2 is connected with the second data signal terminal Vdata2, and a second electrode of the second transistor M2 is connected with the first node N1.

An exemplary structure of the preceding charging sub-circuit and the succeeding charging sub-circuit is shown in FIG. 3. Those skilled in the art may easily understand that implementations of the preceding charging sub-circuit and the succeeding charging sub-circuit are not limited thereto as long as their respective functions can be realized.

Figure 4:
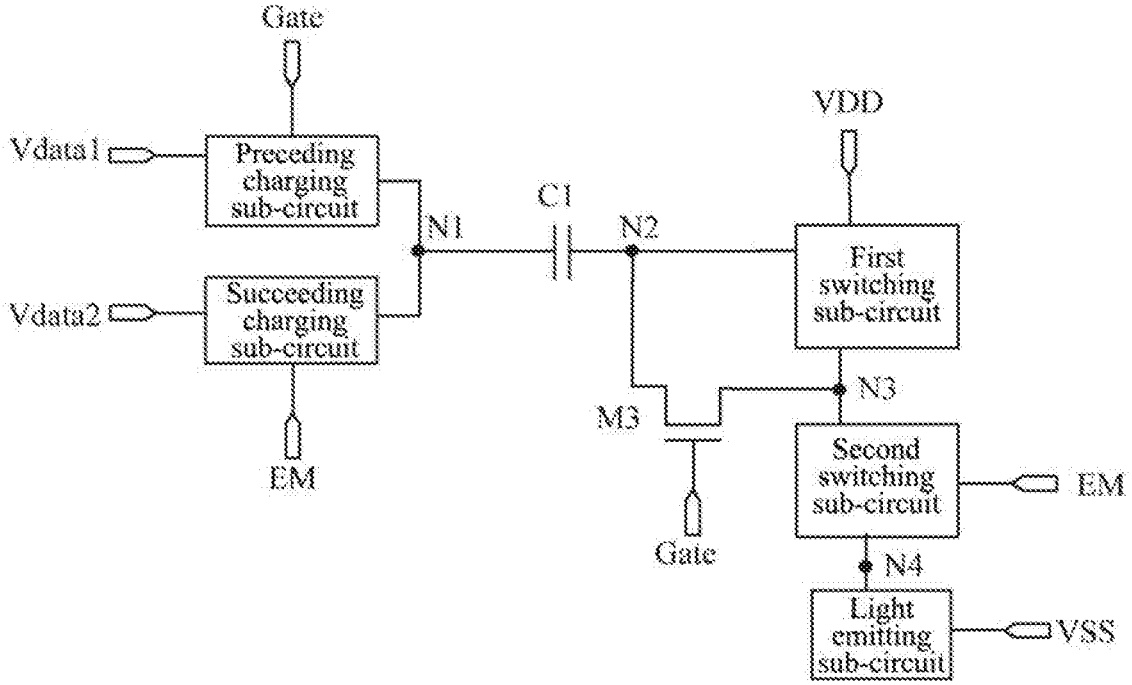
FIG. 4 is an equivalent circuit diagram of a second charging sub-circuit and a first storage sub-circuit according to an embodiment of the present disclosure.

FIG. 4 is an equivalent circuit diagram of the second charging sub-circuit and the first storage sub-circuit provided by an embodiment of the disclosure. As shown in FIG. 4, in an exemplary embodiment, the second charging sub-circuit provided by the embodiment of the disclosure includes a third transistor M3, and the first storage sub-circuit provided by the embodiment of the disclosure includes a first capacitor C1.

A control electrode of the third transistor M3 is connected with the scanning signal terminal Gate, a first electrode of the third transistor M3 is connected with the second node N2, and a second electrode of the third transistor M3 is connected with the third node N3.

One end of the first capacitor C1 is connected with the first node N1, and the other end of the first capacitor C1 is connected with the second node N2.

An exemplary structure of the second charging sub-circuit and the first storage sub-circuit is shown in FIG. 4. Those skilled in the art may easily understand that implementations of the second charging sub-circuit and the first storage sub-circuit are not limited thereto as long as their respective functions can be realized.

Figure 5:
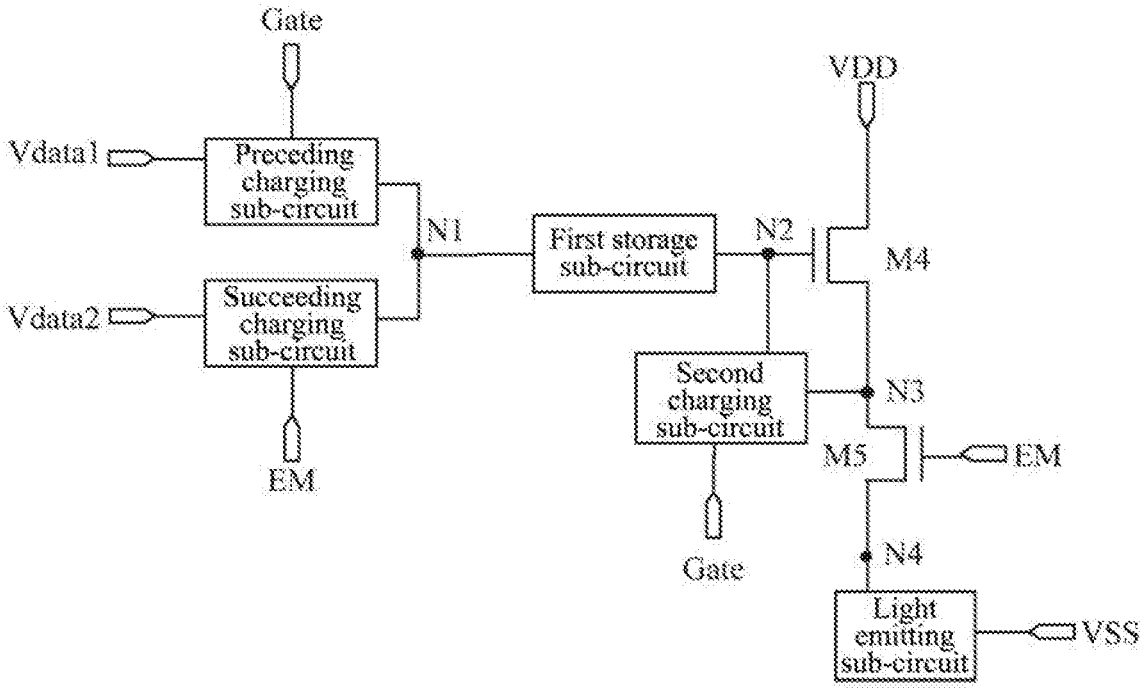
FIG. 5 is an equivalent circuit diagram of a first switching sub-circuit and a second switching sub-circuit according to an embodiment of the present disclosure.

FIG. 5 is an equivalent circuit diagram of the first switching sub-circuit and the second switching sub-circuit provided by an embodiment of the disclosure. As shown in FIG. 5, in an exemplary embodiment, the first switching sub-circuit provided by the embodiment of the disclosure includes a fourth transistor M4, and the second switching sub-circuit by the embodiment of the disclosure includes a fifth transistor M5.

A control electrode of the fourth transistor M4 is connected with the second node N2, a first electrode of the fourth transistor M4 is connected with a first voltage terminal VDD, and a second electrode of the fourth transistor M4 is connected with the third node N3.

A control electrode of the fifth transistor M5 is connected with the light emitting control terminal EM, a first electrode of the fifth transistor M5 is connected with the third node N3, and a second electrode of the fifth transistor M5 is connected with the fourth node N4.

An exemplary structure of the first switching sub-circuit and the second switching sub-circuit is shown in FIG. 5. Those skilled in the art may easily understand that implementations of the first switching sub-circuit and the second switching sub-circuit are not limited thereto as long as their respective functions can be realized.

From the above, it can be seen that a current path can be conducted only when the first switching sub-circuit and the second switching sub-circuit are both in a turned-on state. In this way, the effective brightness of the light emitting element L may be controlled cooperatively by the first switching sub-circuit and the second switching sub-circuit, factors that affect the effective brightness of the light emitting element L are increased, so that gray tone values of subpixels with the pixel circuit which can be displayed are more diversified.

In an exemplary embodiment, an anode of the light emitting element L is connected with the fourth node N4, and a cathode of the light emitting element L is connected with the second voltage terminal VSS.

Figure 6:
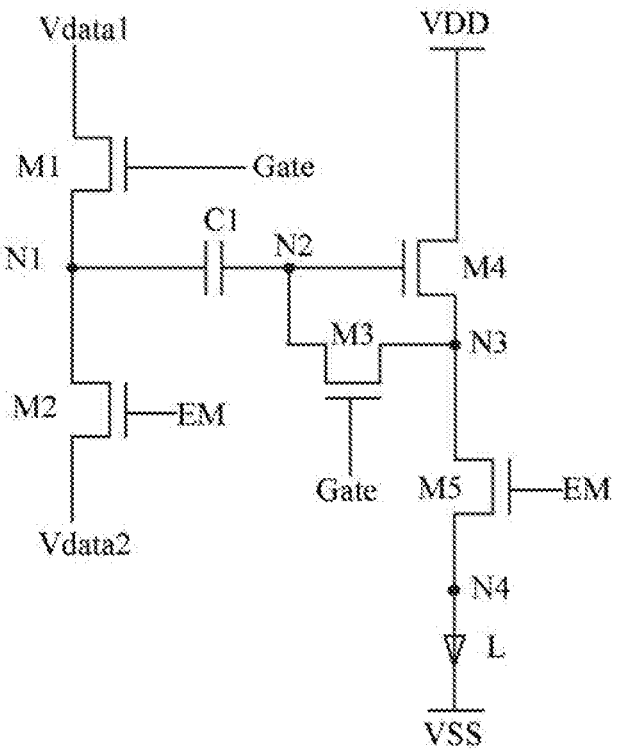
FIG. 6 is a first equivalent circuit diagram of a pixel circuit according to an embodiment of the present disclosure.

FIG. 6 is a first equivalent circuit diagram of a pixel circuit provided in an embodiment of the disclosure. As shown in FIG. 6, in an exemplary embodiment, a first charging sub-circuit includes a preceding charging sub-circuit and a succeeding charging sub-circuit. The preceding charging sub-circuit includes a first transistor M1, and the succeeding charging sub-circuit includes a second transistor M2. A second charging sub-circuit includes a third transistor M3, a first storage sub-circuit includes a first capacitor C1, a first switching sub-circuit includes a fourth transistor M4, a second switching sub-circuit includes a fifth transistor M5, and a light emitting sub-circuit includes a light emitting element L.

A control electrode of the first transistor M1 is connected with the scanning signal terminal Gate, a first electrode of the first transistor M1 is connected with the first data signal terminal Vdata1, and a second electrode of the first transistor M1 is connected with the first node N1. A control electrode of the second transistor M2 is connected with the light emitting control terminal EM, a first electrode of the second transistor M2 is connected with the second data signal terminal Vdata2, and a second electrode of the second transistor M2 is connected with the first node N1. A control electrode of the third transistor M3 is connected with the scanning signal terminal Gate, a first electrode of the third transistor M3 is connected with the second node N2, and a second electrode of the third transistor M3 is connected with the third node N3. One end of the first capacitor C1 is connected with the first node N1, and the other end of the first capacitor C1 is connected with the second node N2. A control electrode of the fourth transistor M4 is connected with the second node N2, a first electrode of the fourth transistor M4 is connected with the first voltage terminal VDD, and a second electrode of the fourth transistor M4 is connected with the third node N3. A control electrode of the fifth transistor M5 is connected with the light emitting control terminal EM, a first electrode of the fifth transistor M5 is connected with the third node N3, and a second electrode of the fifth transistor M5 is connected with the fourth node N4. An anode of the light emitting element L is connected with the fourth node N4, and an cathode of the light emitting element L is connected with the second voltage terminal VSS.

FIG. 6 shows an exemplary structure of the preceding charging sub-circuit, the succeeding charging sub-circuit, the second charging sub-circuit, the first storage sub-circuit, the first switching sub-circuit, the second switching sub-circuit and the light emitting sub-circuit in the pixel circuit. Those skilled in the art may easily understand that implementations of the above various sub-circuits are not limited thereto as long as their respective functions can be realized.

In an exemplary embodiment, the first transistor M1 to the fifth transistor M5 may all be N-type thin film transistors or P-type thin film transistors, the process can be unified to be beneficial for improving the yield of products. Considering that a leakage current of a low-temperature polysilicon thin film transistor is small, in an exemplary embodiment, all transistors are low-temperature polysilicon thin film transistors, and thin film transistors with bottom gate structures or thin film transistors with top gate structures may be selected as long as switch functions can be realized.

In an exemplary embodiment, the first capacitor C1 may be a liquid crystal capacitor composed of a pixel electrode and a common electrode, or may be an equivalent capacitor composed of a storage capacitor and a liquid crystal capacitor composed of a pixel electrode and a common electrode, and this is not restricted in the disclosure.

Taking a working process of a first-level pixel circuit as an example, the technical solution of an embodiment of the present disclosure is illustrated below through the working process of the pixel circuit.

Figure 7:
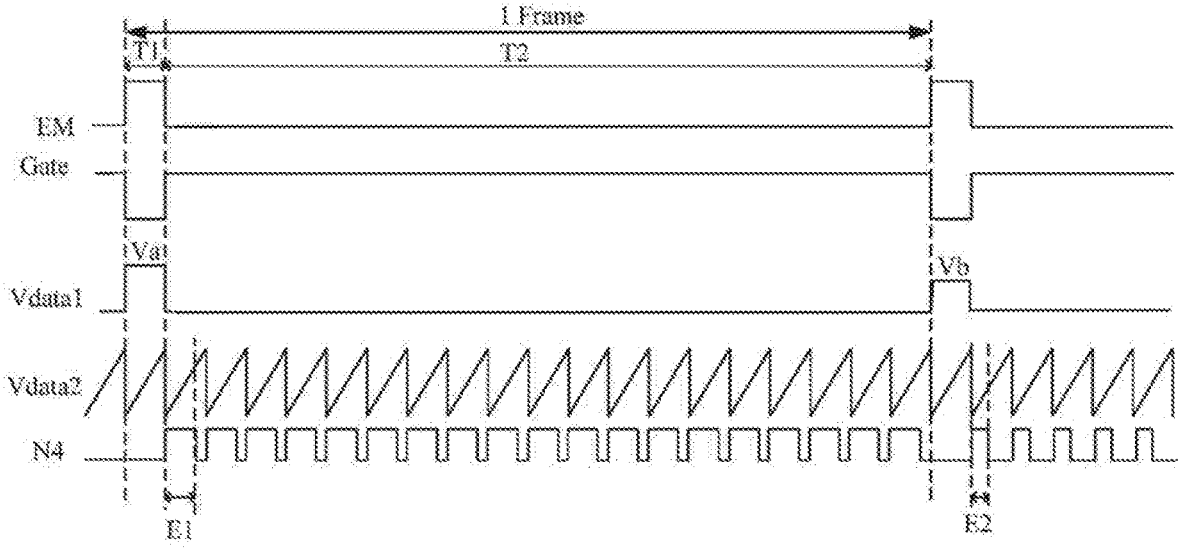
FIG. 7 is a first working timing diagram of a pixel circuit according to an embodiment of the disclosure.

Taking all of the transistors T1 to T5 in the pixel circuit provided by an embodiment of the present disclosure being P-type thin film transistors as an example, FIG. 7 is a first working timing diagram of the pixel circuit provided by an embodiment of the present disclosure. As shown in FIGS. 6 and 7, the pixel circuit provided by an embodiment of the present disclosure includes five transistor units (M1 to M5), one capacitor unit (C1), two signal input terminals (Gate and EM) and four power supply terminals (Vdata1, Vdata2, VDD, VSS). The working process includes the following input phase T1 and light emitting control phase T2.

In the input phase T1, a low level is applied to the scanning signal terminal Gate to turn on the first transistor M1 and the third transistor M3, and a high level is applied to the light emitting control terminal EM to turn off the second transistor M2 and the fifth transistor M5, and a first data voltage V1 is applied to the first data signal terminal Vdata1 (it is shown in the figure that the first data voltage V1 may be different in various frame display periods, for example, the first data voltage V1 shown in the figure may be Va in a first frame display period, or may be Vb in a second frame display period, wherein Vb is less than Va). As shown in FIG. 6, the first voltage terminal VDD charges the second node N2 via the fourth transistor M4 and the third transistor M3 until a voltage of the second node N2 reaches VDD+Vth (at this time, a cut-off condition of the fourth transistor M4 is reached, Vth here is a turn-on threshold of the fourth transistor M4 and is negative here). In this stage, since the fifth transistor M5 is turned off, the light emitting element L does not emit light at this time, thus prolonging a service life of the light emitting element L. Due to turning-on of the first transistor M1, the first data voltage V1 is written to the first node N1. At this time, a voltage difference between the first node N1 and the second node N2 is VDD+Vth−V1.

In the light emitting control phase T2, a low level is applied to the light emitting control terminal EM and a high level is applied to the scanning signal terminal Gate, at this time, the second transistor M2 and the fifth transistor M5 are turned on, and the first transistor M1 and the third transistor M3 are turned off. As shown in FIG. 6, the second data signal terminal Vdata2 is conducted with the first node N1 via the second transistor M2. At this time, a voltage of the first node N1 is set to a second data voltage V2 output by the second data signal terminal Vdata2, and since the second node N2 floats, at this time the voltage of the second node N2 jumps to VDD+Vth−V1+V2 (keeping a voltage difference across the first capacitor C1 as VDD+Vth−V1).

In an embodiment of the present disclosure, the second data voltage V2 of the second data signal terminal Vdata2 may be a voltage signal having a time-varying amplitude within one frame. For example, the second data voltage of the second data signal terminal Vdata2 may be a triangular wave voltage, a sine voltage or a cosine voltage signal that jumps all the time in one frame. An initial amplitude of the second data voltage is suggested to be 0V, and a maximum amplitude is greater than or equal to the amplitude of the first data voltage V1. When the second data voltage V2 jumps to the initial amplitude of 0V, the voltage of the second node N2 jumps to VDD+Vth−V1, at this time a gate-source voltage of the fourth transistor M4 Vgs=VDD+Vth−V1−VDD=Vth−V1<Vth, and the fourth transistor M4 is in a turned-on state, at this time the first voltage terminal VDD provides a current to the light emitting element L through the fourth transistor M4 and the fifth transistor M5 to enable the light emitting element L to emit light. When the voltage amplitude of the second data voltage V2 output from the second data signal terminal Vdata2 gradually increases to the amplitude of the first data voltage V1, the voltage of the second node N2 jumps to VDD+Vth, and the fourth transistor M4 is turned off, at this time the light emitting element L does not emit light.

Figure 10:
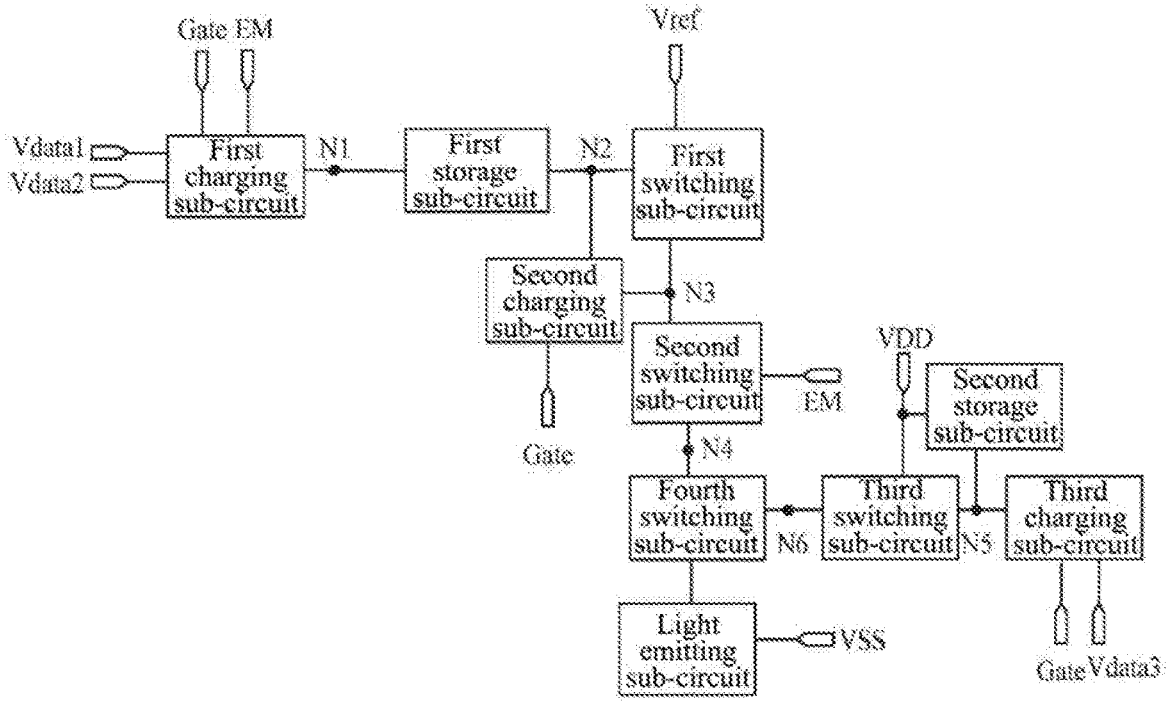
FIG. 10 is a fourth structural diagram of a pixel circuit according to an embodiment of the present disclosure.

As shown in FIG. 7, in a process of displaying one frame of image, the pixel circuit has multiple light emitting stages, for example, in a process of displaying a first frame of image, the pixel circuit has multiple first light emitting stages E1; in a process of displaying a second frame of image, the pixel circuit has multiple second light emitting stages E2; . . . , in a process of displaying a N-th frame of image, the pixel circuit has multiple N-th light emitting stages En. Only two light emitting stages are shown in FIG. 10, i.e., the first light emitting stage E1 and the second light emitting stage E2. Effective light emitting time lengths of various light emitting stages may be the same or different.

In an embodiment of the present disclosure, an overall brightness of a pixel unit including the pixel circuit in the process of displaying one frame of image may be obtained by adding light emitting brightness of the light emitting element L in the pixel circuit in multiple light emitting stages.

In an embodiment of the present disclosure, the above pixel circuit enables the micro LED of the pixel unit to display, for example, a low gray tone. For example, the pixel unit including the micro LED can display a low gray tone by reducing the light emitting time length of the micro LED. For example, the pixel nit including the micro LED can display a desired gray tone by controlling the light emitting time length of the micro LED.

Some embodiments of the present disclosure further provide a driving method of the pixel circuit, which is applied to the pixel circuit provided in the previous embodiments. In an image frame, the pixel circuit has multiple scanning periods.

Figure 8:
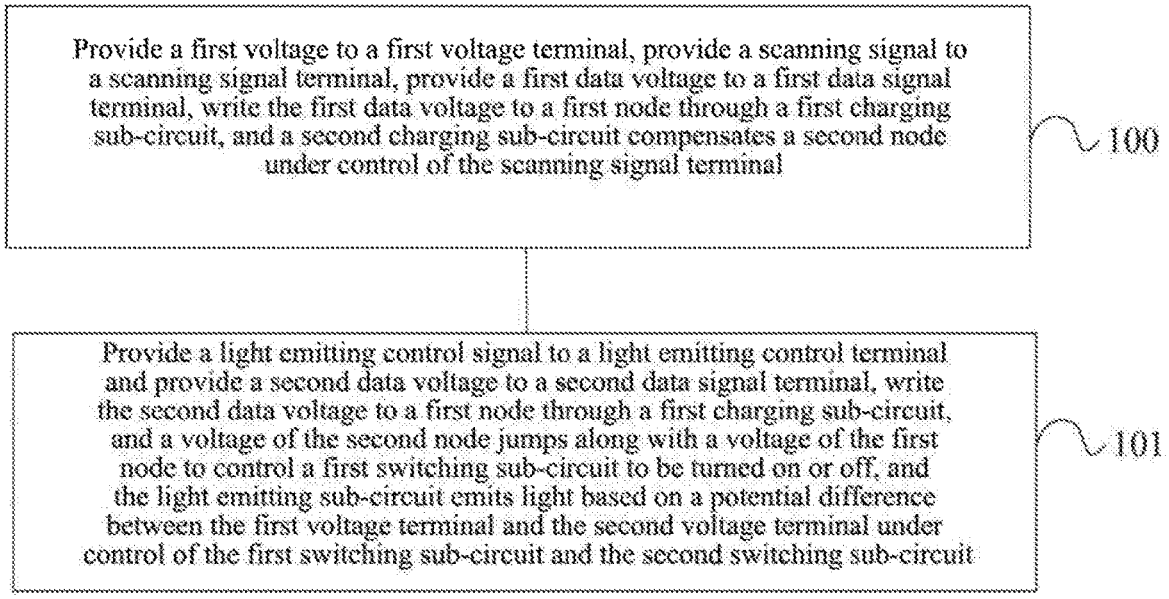
FIG. 8 is a first flowchart of a driving method of a pixel circuit according to an embodiment of the disclosure.

In one scanning period (for example, a first scanning period), a driving method of the pixel circuit, as shown in FIG. 8, includes acts 100 to 101.

The act 100 includes: providing a first voltage to a first voltage terminal, providing a scanning signal to a scanning signal terminal, providing a first data voltage to a first data signal terminal, writing the first data voltage to a first node through a first charging sub-circuit, and compensating a second node by a second charging sub-circuit under control of the scanning signal terminal.

In an exemplary embodiment, when the second charging sub-circuit compensates the second node under the control of the scanning signal terminal, a voltage of the second node is compensated as a sum of the first voltage provided by the first voltage terminal and a threshold voltage of a first switching sub-circuit.

The act 101 includes: providing a light emitting control signal to a light emitting control terminal and providing a second data voltage to a second data signal terminal, writing the second data voltage to a first node through a first charging sub-circuit, and a voltage of the second node jumping along with a voltage of the first node to control a first switching sub-circuit to be turned on or off, and emitting light by the light emitting sub-circuit based on a potential difference between the first voltage terminal and the second voltage terminal under control of the first switching sub-circuit and the second switching sub-circuit.

In an exemplary embodiment, an amplitude of the second data voltage varies with time.

In an exemplary embodiment, the second data voltage may be a triangular wave signal, a sine signal, or a cosine signal.

According to the driving method of the pixel circuit provided by an embodiment of the disclosure, the second charging sub-circuit compensates the second node under the control of the scanning signal terminal, thus a situation in which variation of the threshold voltage of the first switching sub-circuit during the display process affects light emitting brightness of the light emitting element L is avoided, thereby beneficial for remaining the light emitting brightness of the light emitting element L stable during the display process, and further beneficial for improving the display effect. In addition, by setting the signal of the second data signal terminal as a signal having a time-varying amplitude, the first switching sub-circuit is controlled to be turned on or off with time, the light emitting time length of the light emitting element L is controlled accordingly, and the effective brightness of the light emitting element L can be controlled, thus achieving a purpose of adjusting a display gray tone.

Figure 9:
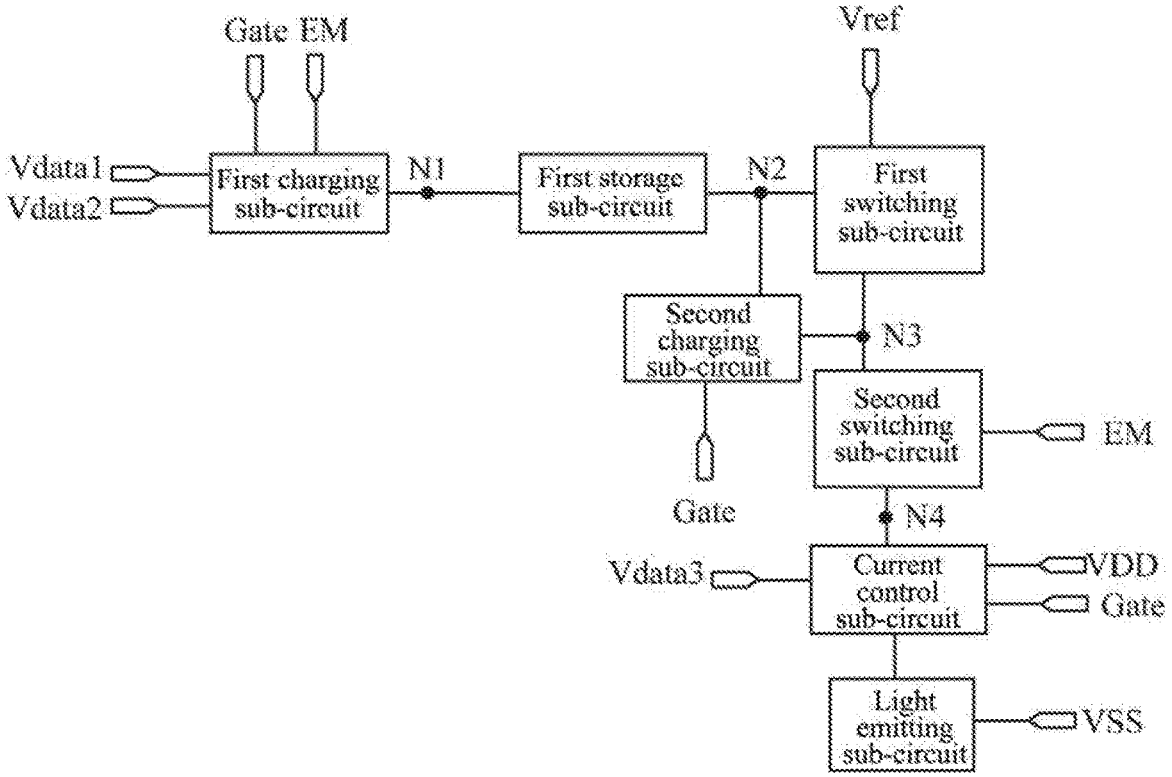
FIG. 9 is a third structural diagram of a pixel circuit according to an embodiment of the present disclosure.

An embodiment of the present disclosure further provides a pixel circuit. FIG. 9 is a third structural diagram of the pixel circuit according to an embodiment of the present disclosure. This embodiment is an extension of the pixel circuit of the above embodiments. The main structure of the pixel circuit in this embodiment is basically the same as that of the above embodiments of the present disclosure, except that the first switching sub-circuit of this embodiment is connected with the third voltage terminal Vref, the second node N2 and the third node N3, respectively, and is configured to provide a signal of the third voltage terminal Vref to the third node N3 under control of the second node N2. For example, a control terminal of the first switching sub-circuit is connected with the second node N2, a first terminal of the first switching sub-circuit is connected with the third voltage terminal Vref, and a second terminal of the first switching sub-circuit is connected with the third node N3. The pixel circuit of this embodiment further includes a current control sub-circuit connected between the fourth node N4 and the light emitting sub-circuit. The current control sub-circuit is connected with the scanning signal terminal Gate, the first voltage terminal VDD, and the third data signal terminal Vdata3, respectively, and is configured to output a preset current to the light emitting sub-circuit under control of the fourth node N4 and the scanning signal terminal Gate. According to an embodiment of the disclosure, the current control sub-circuit controls the light emitting element L in the light emitting sub-circuit to always work in a high current density region, i.e., a device efficiency stable region, thereby ensuring the light emitting efficiency of the light emitting element L and improving working stability of the light emitting element L. In addition, the light emitting control sub-circuit (including the aforementioned first charging sub-circuit, the second charging sub-circuit, the storage sub-circuit, the first switching sub-circuit and the second switching sub-circuit) controls the light emitting time length of the light emitting element L, thereby accurately and effectively controlling the brightness and gray tone of the light emitting element L.

In the following, how to control the light emitting element L to always work in a high current density region through the current control sub-circuit will be explained in detail in combination with the structure of the current control sub-circuit.

FIG. 10 is a fourth structural diagram of a pixel circuit according to an embodiment of the present disclosure. In an exemplary embodiment, as shown in FIG. 10, the current control sub-circuit may include a third charging sub-circuit, a second storage sub-circuit, a third switching sub-circuit and a fourth switching sub-circuit.

The third charging sub-circuit is connected with the scanning signal terminal Gate, the third data signal terminal Vdata3 and the fifth node N5, respectively, and is configured to provide a signal of the third data signal terminal Vdata3 to the fifth node N5 under the control of the scanning signal terminal Gate. The second storage sub-circuit is connected with the first voltage terminal VDD and the fifth node N5, respectively, and is configured to store an amount of charge between the first voltage terminal VDD and the fifth node N5. The third switching sub-circuit is connected with the first voltage terminal VDD, the fifth node N5 and the sixth node N6, respectively, and is configured to provide a signal of the first voltage terminal VDD to the sixth node N6 under the control of the fifth node N5. The fourth switching sub-circuit is connected with the sixth node N6, one terminal of the light emitting sub-circuit and the fourth node N4, respectively, and is configured to provide a signal of the sixth node N6 to the light emitting sub-circuit under the control of the fourth node N4. In this embodiment, the first voltage output from the first voltage terminal VDD may be a constant high level, and a third voltage output from the third voltage terminal Vref may be a constant low level.

Figure 11:
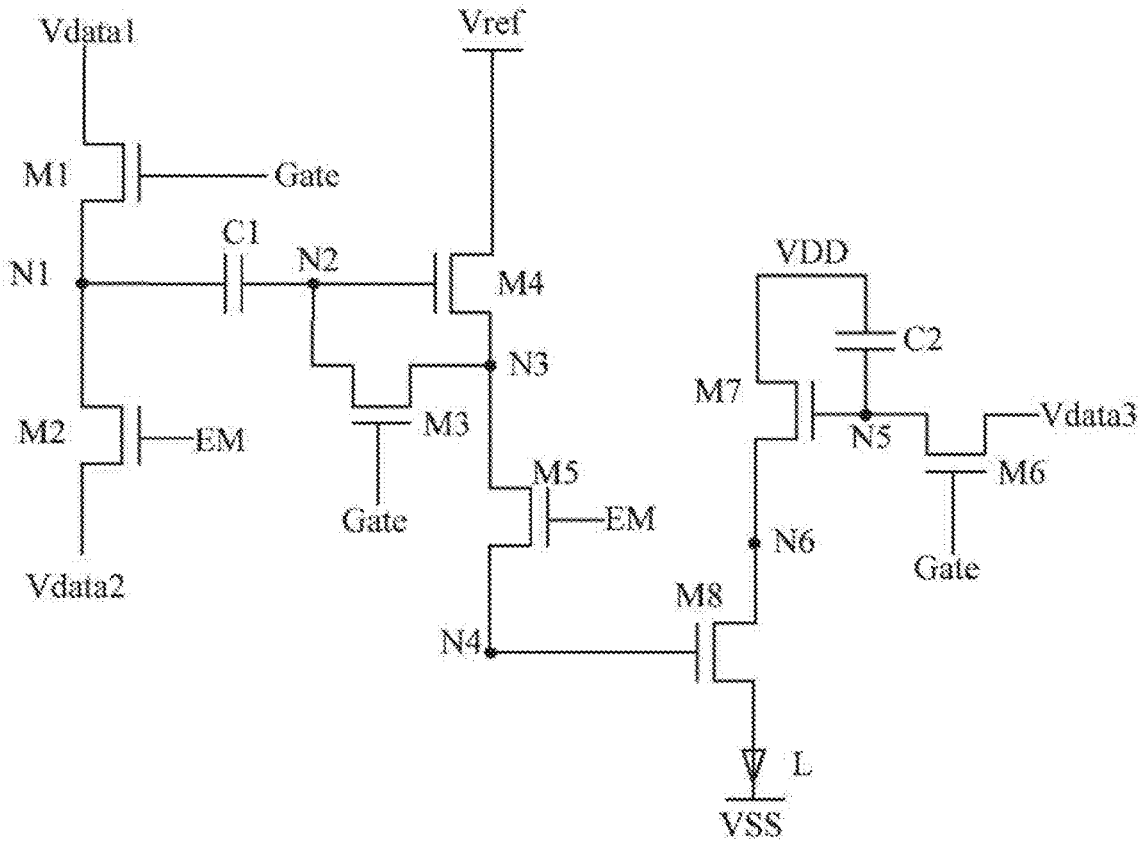
FIG. 11 is a second equivalent circuit diagram of a pixel circuit according to an embodiment of the present disclosure.

FIG. 11 is a second equivalent circuit diagram of a pixel circuit provided in an embodiment of the disclosure. As shown in FIG. 11, in an exemplary embodiment, a first charging sub-circuit includes a preceding charging sub-circuit and a succeeding charging sub-circuit. The preceding charging sub-circuit includes a first transistor M1, and the succeeding charging sub-circuit includes a second transistor M2. A second charging sub-circuit includes a third transistor M3, a first storage sub-circuit includes a first capacitor C1, a first switching sub-circuit includes a fourth transistor M4, a second switching sub-circuit includes a fifth transistor M5. A third charging sub-circuit includes a sixth transistor M6, a second storage sub-circuit includes a second capacitor C2, a third switching sub-circuit includes a seventh transistor M7, and a fourth switching sub-circuit includes an eighth transistor M8.

A control electrode of the first transistor M1 is connected with the scanning signal terminal Gate, a first electrode of the first transistor M1 is connected with the first data signal terminal Vdata1, and a second electrode of the first transistor M1 is connected with the first node N1. A control electrode of the second transistor M2 is connected with the light emitting control terminal EM, a first electrode of the second transistor M2 is connected with the second data signal terminal Vdata2, and a second electrode of the second transistor M2 is connected with the first node N1. A control electrode of the third transistor M3 is connected with the scanning signal terminal Gate, a first electrode of the third transistor M3 is connected with the second node N2, and a second electrode of the third transistor M3 is connected with the third node N3. One end of the first capacitor C1 is connected with the first node N1, and the other end of the first capacitor C1 is connected with the second node N2. A control electrode of the fourth transistor M4 is connected with the second node N2, a first electrode of the fourth transistor M4 is connected with the third voltage terminal Vref, and a second electrode of the fourth transistor M4 is connected with the third node N3. A control electrode of the fifth transistor M5 is connected with the light emitting control terminal EM, a first electrode of the fifth transistor M5 is connected with the third node N3, and a second electrode of the fifth transistor M5 is connected with the fourth node N4.

A control electrode of the sixth transistor M6 is connected with the scanning signal terminal Gate, a first electrode of the sixth transistor M6 is connected with the third data signal terminal Vdata3, and a second electrode of the sixth transistor M6 is connected with the fifth node N5. One end of the second capacitor C2 is connected with the fifth node N5, and the other end of the second capacitor C2 is connected with the first voltage terminal VDD. A control electrode of the seventh transistor M7 is connected with the fifth node N5, a first electrode of the seventh transistor M7 is connected with the first voltage terminal VDD, and a second electrode of the seventh transistor M7 is connected with the sixth node N6. A control electrode of the eighth transistor M8 is connected with the fourth node N4, a first electrode of the eighth transistor M8 is connected with the sixth node N6, and a second electrode of the eighth transistor M8 is connected with an anode of the light emitting element L; and a cathode of the light emitting element L is connected with the second voltage terminal VSS.

FIG. 11 shows an exemplary structure of the preceding charging sub-circuit, the succeeding charging sub-circuit, the second charging sub-circuit, the first storage sub-circuit, the first switching sub-circuit, the second switching sub-circuit, the third charging sub-circuit, the second storage sub-circuit, the third switching sub-circuit, the fourth switching sub-circuit and the light emitting sub-circuit in the pixel circuit. Those skilled in the art may easily understand that implementations of the above various sub-circuits are not limited thereto as long as their respective functions can be realized.

In an exemplary embodiment, the first transistor M1 to the eighth transistor M8 may all be N-type thin film transistors or P-type thin film transistors, the process can be unified to be beneficial for improving the yield of products. Considering that a leakage current of a low-temperature polysilicon thin film transistor is small, in an exemplary embodiment, all transistors are low-temperature polysilicon thin film transistors, and thin film transistors with bottom gate structures or thin film transistors with top gate structures may be selected as long as switch functions can be realized.

In an exemplary embodiment, the first capacitor C1 and the second capacitor C2 may be a liquid crystal capacitor composed of a pixel electrode and a common electrode, or may be an equivalent capacitor composed of a storage capacitor and a liquid crystal capacitor composed of a pixel electrode and a common electrode, and this is not restricted in the disclosure.

Taking a working process of a first-level pixel circuit as an example, the technical solution of an embodiment of the present disclosure is illustrated below through the working process of the pixel circuit.

Figure 12:
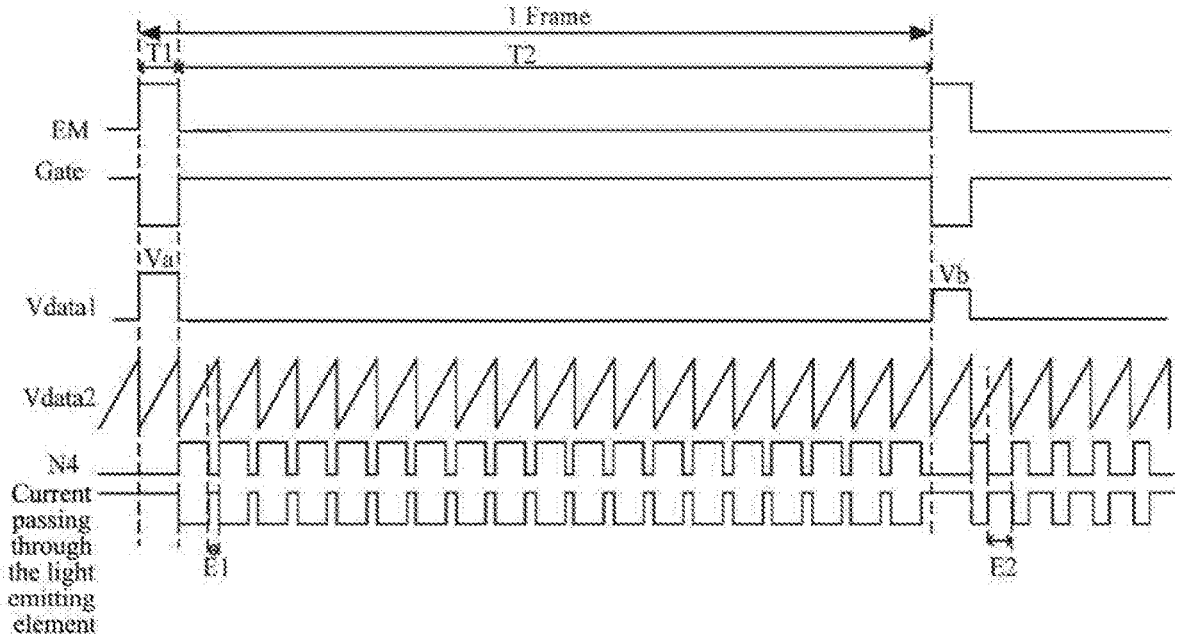
FIG. 12 is a second working timing diagram of a pixel circuit according to an embodiment of the disclosure.

Taking all of the transistors T1 to T8 in the pixel circuit provided by an embodiment of the present disclosure being P-type thin film transistors as an example, FIG. 12 is a second working timing diagram of the pixel circuit provided by an embodiment of the present disclosure. As shown in FIGS. 11 and 12, the pixel circuit provided by an embodiment of the present disclosure includes eight transistor units (M1 to M8), two capacitor units (C1 to C2), two signal input terminals (Gate and EM) and six power supply terminals (Vdata1, Vdata2, Vdata3, Vref, VSS, VDD). The working process includes an input phase T1 and a light emitting control phase T2.

In the input stage T1, a low level is applied to the scanning signal terminal Gate to turn on the first transistor M1, the third transistor M3, and the six transistor M6, and a high level is applied to other various control signal input terminals, and a first data voltage V1 is applied to the first data signal terminal Vdata1 (as shown in the figure, the first data voltage V1 may be different in various frame display periods, for example, the first data voltage V1 shown in the figure may be Va in a first frame display period, and may be Vb in a second frame display period, wherein Vb is less than Va). As shown in FIG. 11, the third voltage terminal Vref charges the second node N2 via the fourth transistor M4 and the third transistor M3 until a voltage of the second node N2 reaches Vref+Vth (at this time, a cut-off condition of the fourth transistor M4 is reached, Vth here is a turn-on threshold of the fourth transistor M4 and is negative here). Due to turning-on of the first transistor M1, the first data voltage V1 is written to the first node N1. At this time, a voltage difference between the first node N1 and the second node N2 is Vref+Vth−V1. The third data voltage of the third data signal terminal Vdata3 is stored in the fifth node. A first voltage is applied to the first voltage terminal VDD, and the seventh transistor M7 generates a driving current for driving the light emitting element L to emit light according to the voltage of the fifth node N5 and outputs the driving current to the sixth node N6. In this phase, since the fifth transistor M5 is turned off and the eighth transistor M8 is also in a turned-off state, the light emitting element L does not emit light at this time, thus prolonging a service life of the light emitting element L.

In the light emitting control phase T2, a low level is applied to the light emitting control terminal EM and a high level is applied to other control signal input terminals. At this time, the second transistor M2 and the fifth transistor M5 are turned on. As shown in FIG. 11, the second data signal terminal Vdata2 is conducted with the first node N1 via the second transistor M2. At this time, the voltage of the first node N1 is set to the second data voltage V2 output by the second data signal terminal Vdata2, and since the second node N2 floats, at this time the voltage of the second node N2 jumps to Vref+Vth−V1+V2 (keeping a voltage difference across the first capacitor C1 as Vref+Vth−V1).

In an embodiment of the present disclosure, the second data voltage V2 of the second data signal terminal Vdata2 may be a voltage signal having a time-varying amplitude. For example, the second data voltage of the second data signal terminal Vdata2 may be a triangular wave voltage, a sine voltage or a cosine voltage signal that jumps all the time in one frame. An initial amplitude of the second data voltage is suggested to be 0V, and a maximum amplitude is greater than or equal to the amplitude of the first data voltage V1. When the second data voltage V2 jumps to the initial amplitude of 0V, the voltage of the second node N2 jumps to Vref+Vth−V1, at this time a gate-source voltage of the fourth transistor M4 Vgs=Vref+Vth−V1−Vref=Vth−V1<Vth, the fourth transistor M4 is in a turned-on state, at this time, a high level time of the fourth node N4 is a turned-off time of the eighth transistor M8, the eighth transistor M8 is turned off, and the pixel does not emit light. When the voltage amplitude of the second data voltage output by the second data signal terminal Vdata2 gradually increases to the amplitude of the first data voltage V1, the voltage of the second node N2 jumps to Vref+Vth, and the fourth transistor M4 is turned off, at this time, a low level time of the fourth node is a turned-on time of the eighth transistor M8, the eighth transistor M8 is turned on, and the current control sub-circuit provides a current to the light emitting element L through the eighth transistor M8 to enable the light emitting element L to emit light.

As shown in FIG. 12, in a process of displaying one frame of image, the pixel circuit has multiple light emitting stages, for example, in a process of displaying a first frame of image, the pixel circuit has multiple first light emitting stages E1; in a process of displaying a second frame of image, the pixel circuit has multiple second light emitting stages E2; . . . , in a process of displaying a N-th frame of image, the pixel circuit has multiple N-th light emitting stages En. Only two light emitting stages are shown in FIG. 10, i.e., the first light emitting stage E1 and the second light emitting stage E2. Effective light emitting time lengths of various light emitting stages may be the same or different.

In an embodiment of the present disclosure, an overall brightness of a pixel unit including the pixel circuit in the process of displaying a frame of image may be obtained by adding light emitting brightness of the light emitting element L in the pixel circuit in multiple light emitting stages.

In an embodiment of the present disclosure, the above pixel circuit enables the light emitting element of the pixel unit to display, for example, a low gray tone, under a condition of high current density. For example, the pixel unit including the light emitting element L can display a low gray tone by reducing the light emitting time length of the light emitting element L working at the high current density. For example, the pixel unit including the light emitting element L can display a desired gray tone by controlling the light emitting time length of the light emitting element L working at the high current density and/or the current density of the driving current.

To sum up, the effective brightness of the light emitting element L in the pixel circuit in an image frame may be determined by multiple factors including the number of scanning periods in an image frame, a time length of each scanning period, the first data voltage, the second data voltage, the third data voltage, and a light emitting control signal provided by the light emitting control signal terminal, thus enabling subpixels with the pixel circuit to display more gray tone values and the display panel to display richer and more exquisite images.

Some embodiments of the present disclosure further provide a driving method of the pixel circuit, which is applied to the pixel circuits provided in FIG. 9 to FIG. 11. In an image frame, the pixel circuit has multiple scanning periods.

Figure 13:
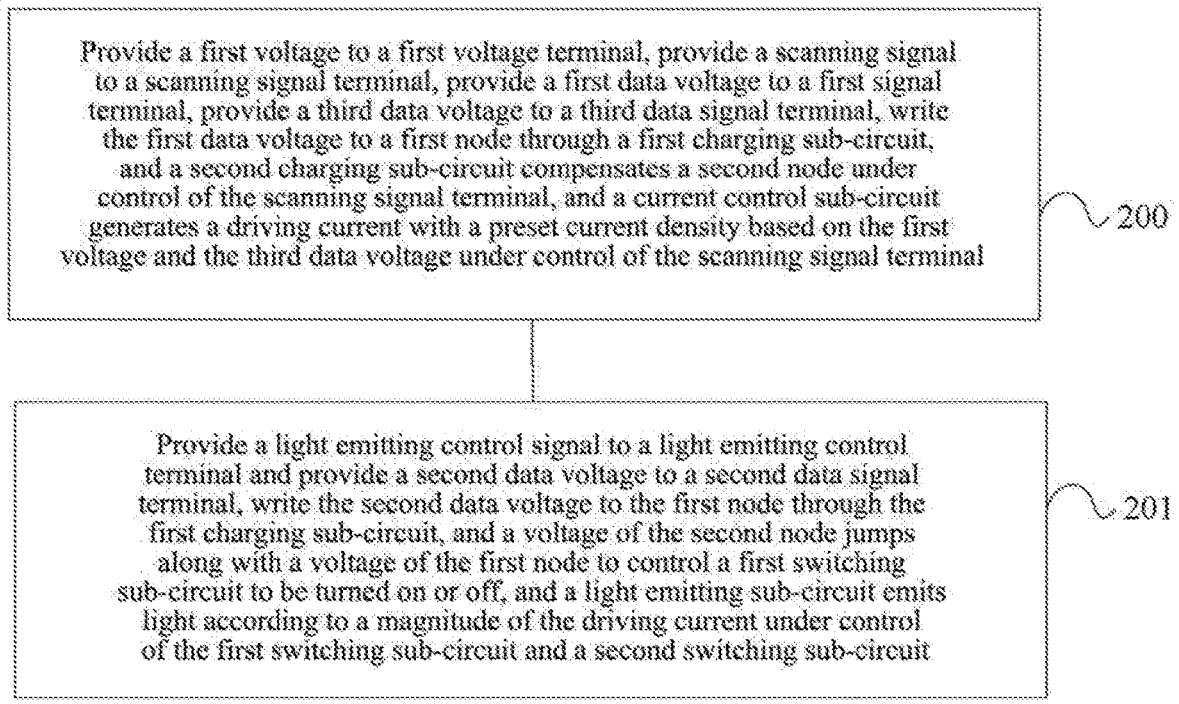
FIG. 13 is a second flowchart of a driving method of a pixel circuit according to an embodiment of the disclosure.

In one scanning period (for example, a first scanning period), a driving method of the pixel circuit, as shown in FIG. 13, includes acts 200 to 201.

The act 200 includes providing a first voltage to a first voltage terminal, providing a scanning signal to a scanning signal terminal, providing a first data voltage to a first signal terminal, providing a third data voltage to a third data signal terminal, writing the first data voltage to a first node through a first charging sub-circuit, and compensating a second node by a second charging sub-circuit under control of the scanning signal terminal, and generating a driving current with a preset current density by a current control sub-circuit based on the first voltage and the third data voltage under control of the scanning signal terminal.

In an exemplary embodiment, when the second charging sub-circuit compensates the second node under the control of the scanning signal terminal, a voltage of the second node is compensated as a sum of a third voltage provided by a third voltage terminal and a threshold voltage of a first switching sub-circuit.

The act 201 includes: providing a light emitting control signal to a light emitting control terminal and providing a second data voltage to a second data signal terminal, writing the second data voltage to the first node through the first charging sub-circuit, and a voltage of the second node jumping along with a voltage of the first node to control a first switching sub-circuit to be turned on or off, and emitting light by the light emitting sub-circuit according to a magnitude of the driving current under control of the first switching sub-circuit and a second switching sub-circuit.

In an exemplary embodiment, an amplitude of the second data voltage varies with time.

In an exemplary embodiment, the second data voltage may be a triangular wave signal, a sine signal, or a cosine signal.

According to the driving method of the pixel circuit provided by an embodiment of the disclosure, the second charging sub-circuit compensates the second node under the control of the scanning signal terminal, thus a situation in which variation of the threshold voltage of the first switching sub-circuit during the display process affects light emitting brightness of the light emitting element L is avoided, thereby beneficial for keeping the light emitting brightness of the light emitting element L stable during the display process, and further beneficial for improving the display effect. In addition, by setting the signal of the second data signal terminal as a signal having a time-varying amplitude, the first switching sub-circuit is controlled to be turned on or off with time, the light emitting time length of the light emitting element L is controlled accordingly, and the effective brightness of the light emitting element L can be controlled, thus achieving a purpose of adjusting a display gray tone. In addition, in the embodiment, the current control sub-circuit controls the light emitting element to always work in a high current density region, i.e., a device efficiency stable region, thereby ensuring the light emitting efficiency of the light emitting element L and improving the working stability of the light emitting element.

Figure 14:
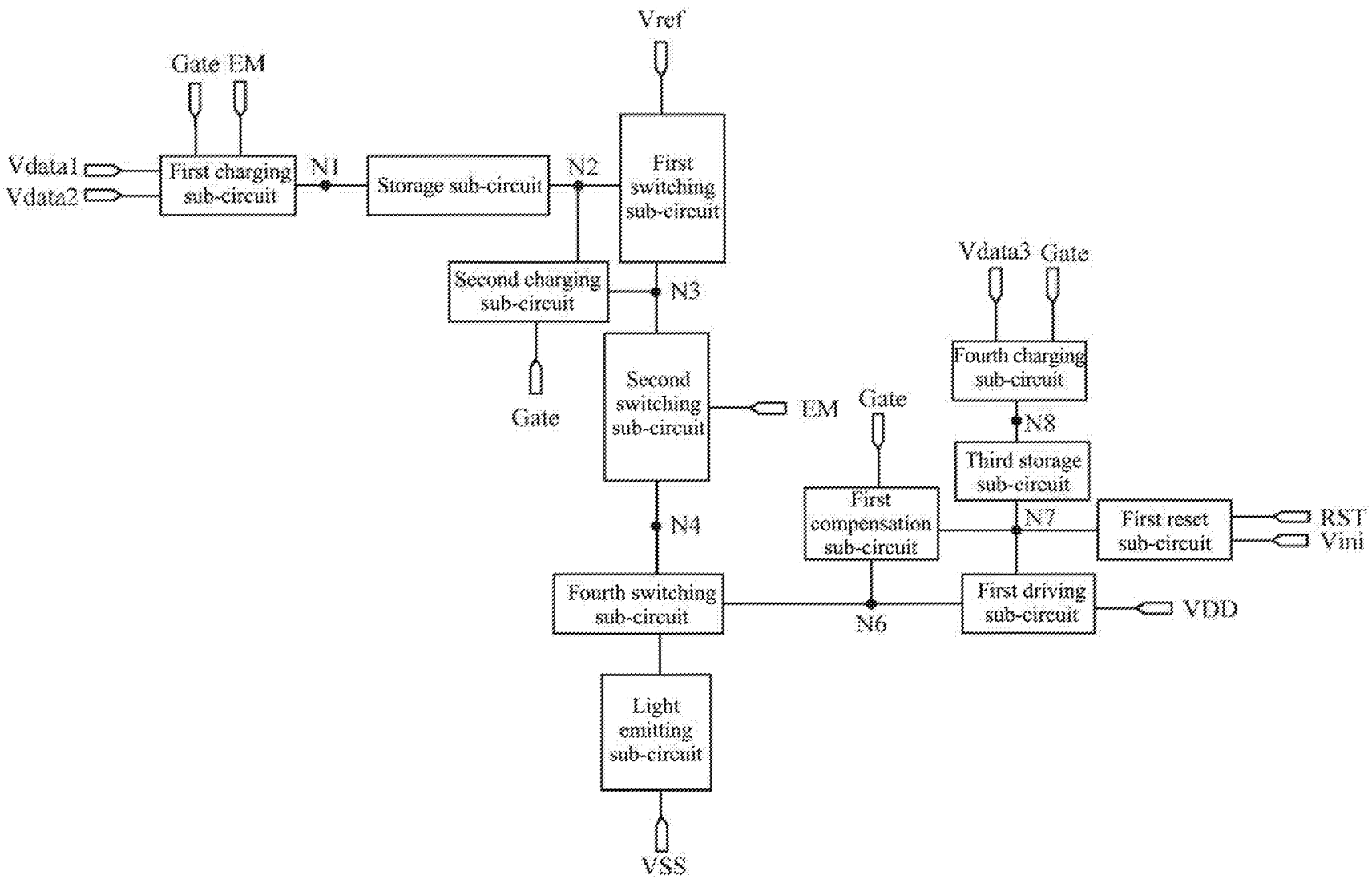
FIG. 14 is a fifth structural diagram of a pixel circuit according to an embodiment of the present disclosure.

An embodiment of the present disclosure further provides a pixel circuit. FIG. 14 is a fifth structural diagram of the pixel circuit according to an embodiment of the present disclosure. This embodiment is an extension of the above embodiments. The main structure of this embodiment is basically the same as those of the above embodiments of the present disclosure, the difference is that the first switching sub-circuit of this embodiment is connected with the third voltage terminal Vref, the second node N2 and the third node N3, respectively, and is configured to provide a signal of the third voltage terminal Vref to the third node N3 under control of the second node N2. For example, a control terminal of the first switching sub-circuit is connected with the second node N2, a first terminal of the first switching sub-circuit is connected with the third voltage terminal Vref, and a second terminal of the first switching sub-circuit is connected with the third node N3. The pixel circuit of this embodiment further includes a current control sub-circuit connected between the fourth node N4 and a terminal of the light emitting sub-circuit. The current control sub-circuit is connected with the scanning signal terminal Gate, the first voltage terminal VDD and the third data signal terminal Vdata3, respectively, and is configured to output a preset current to the anode of the light emitting element L under control of the fourth node N4 and the scanning signal terminal Gate. According to an embodiment of the disclosure, the current control sub-circuit controls the light emitting element L in the light emitting sub-circuit to always work in a high current density region, i.e., a device efficiency stable region, thereby ensuring the light emitting efficiency of the light emitting element L and improving working stability of the light emitting element L. In addition, the light emitting control sub-circuit (including the aforementioned first charging sub-circuit, the second charging sub-circuit, the storage sub-circuit, the first switching sub-circuit and the second switching sub-circuit) controls the light emitting time length of the light emitting element L, thereby accurately and effectively controlling the brightness and gray tone of the light emitting element L.

In the following, how to control the light emitting element L to always work in a high current density region through the current control sub-circuit will be explained in detail in combination with the structure of the current control sub-circuit.

FIG. 14 is a fifth structural diagram of a pixel circuit according to an embodiment of the present disclosure. In an exemplary embodiment, as shown in FIG. 14, the current control sub-circuit may include a first reset sub-circuit, a fourth charging sub-circuit, a third storage sub-circuit, a first compensation sub-circuit, a first driving sub-circuit, and a fourth switching sub-circuit.

The first reset sub-circuit is connected with a reset control signal terminal RST, a reset voltage terminal Vini and a seventh node N7, respectively, and is configured to write the signal of the reset voltage terminal Vini into the seventh node N7 under control of the reset control signal terminal RST. The fourth charging sub-circuit is connected with the scanning signal terminal Gate, the third data signal terminal Vdata3 and the eighth node N8, respectively, and is configured to provide a signal of the third data signal terminal Vdata3 to the eighth node N8 under control of the scanning signal terminal Gate. The third storage sub-circuit is connected with the seventh node N7 and the eighth node N8, respectively, and is configured to store an amount of charge between the seventh node N7 and the eighth node N8. The first compensation sub-circuit is connected with the scanning signal terminal Gate, the sixth node N6 and the seventh node N7, respectively, and is configured to compensate the voltage of the seventh node N7 under control of the scanning signal terminal Gate. The first driving sub-circuit is connected with the sixth node N6, the seventh node N7 and the first voltage terminal VDD, respectively, and is configured to generate a driving current according to the voltage across the first voltage terminal VDD and output the driving current to the sixth node N6 under control of the seventh node N7. The fourth switching sub-circuit is connected with the sixth node N6, one terminal of the light emitting sub-circuit and the fourth node N4, respectively, and is configured to provide a signal of the sixth node N6 to the light emitting sub-circuit under control of the fourth node N4.

Figure 15:
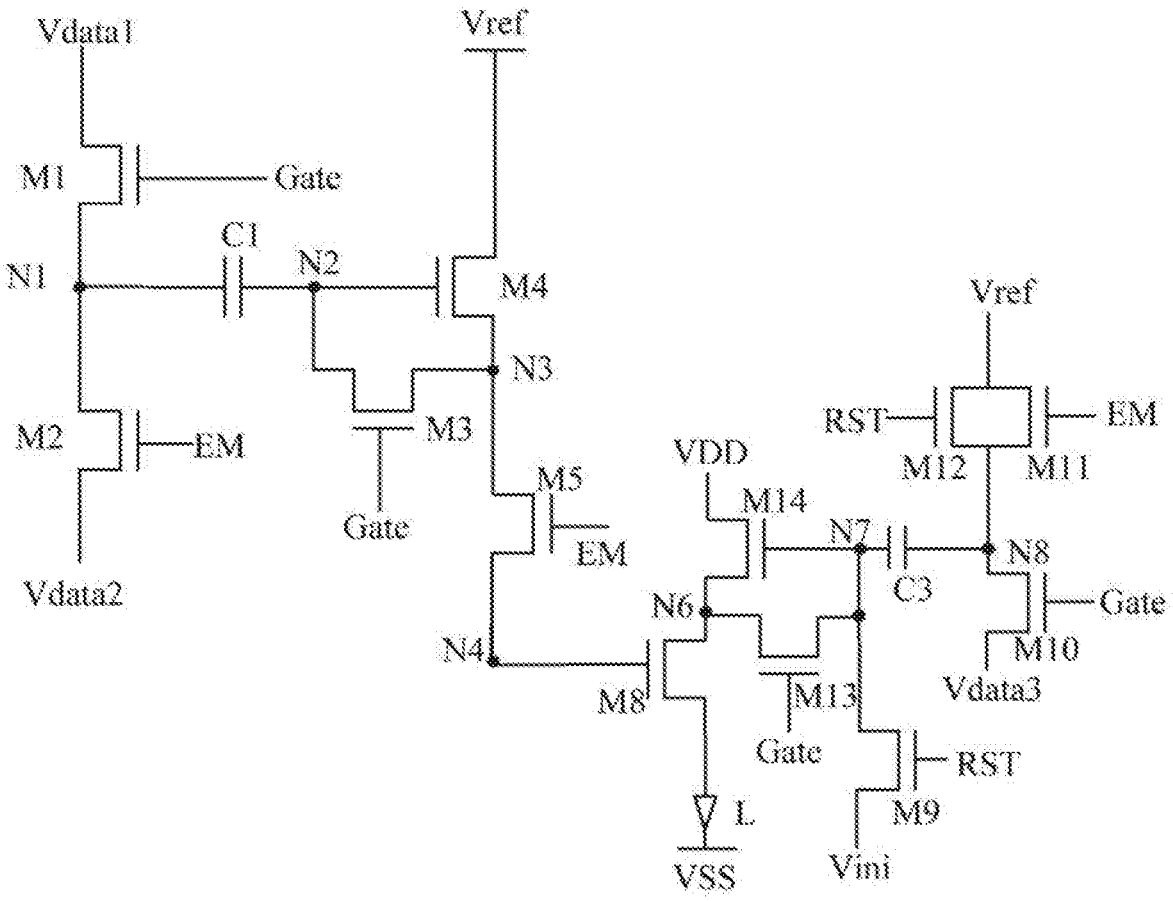
FIG. 15 is a third equivalent circuit diagram of a pixel circuit according to an embodiment of the present disclosure.

FIG. 15 is a third equivalent circuit diagram of a pixel circuit provided in an embodiment of the disclosure. As shown in FIG. 15, in an exemplary embodiment, a first charging sub-circuit includes a preceding charging sub-circuit and a succeeding charging sub-circuit. The preceding charging sub-circuit includes a first transistor M1, and the succeeding charging sub-circuit includes a second transistor M2. A second charging sub-circuit includes a third transistor M3, a first storage sub-circuit includes a first capacitor C1, a first switching sub-circuit includes a fourth transistor M4, a second switching sub-circuit includes a fifth transistor M5. A fourth switching sub-circuit includes an eighth transistor M8, a first reset sub-circuit includes a ninth transistor M9, a fourth charging sub-circuit includes a tenth transistor M10, an eleventh transistor M11 and a twelfth transistor M12, the third storage sub-circuit includes a third capacitor C3, a first compensation sub-circuit includes a thirteenth transistor M13, a first driving sub-circuit includes a fourteenth transistor M14, and a light emitting sub-circuit includes a light emitting element L.

A control electrode of the first transistor M1 is connected with the scanning signal terminal Gate, a first electrode of the first transistor M1 is connected with the first data signal terminal Vdata1, and a second electrode of the first transistor M1 is connected with the first node N1. A control electrode of the second transistor M2 is connected with the light emitting control terminal EM, a first electrode of the second transistor M2 is connected with the second data signal terminal Vdata2, and a second electrode of the second transistor M2 is connected with the first node N1. A control electrode of the third transistor M3 is connected with the scanning signal terminal Gate, a first electrode of the third transistor M3 is connected with the second node N2, and a second electrode of the third transistor M3 is connected with the third node N3. One end of the first capacitor C1 is connected with the first node N1, and the other end of the first capacitor C1 is connected with the second node N2. A control electrode of the fourth transistor M4 is connected with the second node N2, a first electrode of the fourth transistor M4 is connected with the third voltage terminal Vref, and a second electrode of the fourth transistor M4 is connected with the third node N3. A control electrode of the fifth transistor M5 is connected with the light emitting control terminal EM, a first electrode of the fifth transistor M5 is connected with the third node N3, and a second electrode of the fifth transistor M5 is connected with the fourth node N4.

A control electrode of the eighth transistor M8 is connected with the fourth node N4, a first electrode of the eighth transistor M8 is connected with the sixth node N6, and a second electrode of the eighth transistor M8 is connected to an anode of the light emitting element L. A control electrode of the ninth transistor M9 is connected with the reset control signal terminal RST, a first electrode of the ninth transistor M9 is connected with the reset voltage terminal Vini, and a second electrode of the ninth transistor M9 is connected with the seventh node N7. A control electrode of the tenth transistor M10 is connected with the scanning signal terminal Gate, a first electrode of the tenth transistor M10 is connected with the third data signal terminal Vdata3, and a second electrode of the tenth transistor M10 is connected with the eighth node N8. A control electrode of the eleventh transistor M11 is connected with the light emitting control terminal EM, a first electrode of the eleventh transistor M11 is connected with the third voltage terminal Vref, and a second electrode of the eleventh transistor M11 is connected with the eighth node N8. A control electrode of the twelfth transistor M12 is connected with the reset control signal terminal RST, a first electrode of the twelfth transistor M12 is connected with the third voltage terminal Vref, and a second electrode of the twelfth transistor M12 is connected with the eighth node N8. One end of the third capacitor C3 is connected with the seventh node N7, and the other end of the third capacitor C3 is connected with the eighth node N8. A control electrode of the thirteenth transistor M13 is connected with the scanning signal terminal Gate, a first electrode of the thirteenth transistor M13 is connected with the sixth node N6, and a second electrode of the thirteenth transistor M13 is connected with the seventh node N7. A control electrode of the fourteenth transistor M14 is connected with the seventh node N7, a first electrode of the fourteenth transistor M14 is connected with the first voltage terminal VDD, and a second electrode of the fourteenth transistor M14 is connected with the sixth node N6.

FIG. 15 shows an exemplary structure of the preceding charging sub-circuit, the succeeding charging sub-circuit, the second charging sub-circuit, the first storage sub-circuit, the first switching sub-circuit, the second switching sub-circuit, the first reset sub-circuit, the fourth charging sub-circuit, the third storage sub-circuit, the first compensation sub-circuit, the first driving sub-circuit, the fourth switching sub-circuit and the light emitting sub-circuit in the pixel circuit. Those skilled in the art may easily understand that implementations of the above various sub-circuits are not limited thereto as long as their respective functions can be realized.

In an exemplary embodiment, the reset voltage Vini may be a low level, so that a driving transistor (i.e., the fourteenth transistor M14) is in a state that it is nearly turned on but is not yet turned on, thus preparing for charging the gate of the driving transistor during the following data writing phase, and the third data voltage Vdata3 provided at the third data signal terminal can charge the gate of the driving transistor more quickly. Therefore, during a subsequent data writing phase, when different data voltages are written to the driving transistor, writing time of the data voltages can be reduced, therefore, for all pixel circuits of the entire display panel, the response time of each of all driving transistors is almost the same, and the writing time of the data voltages is approximately the same. For the entire display panel, this arrangement makes the display effect more uniform.

The working process of the pixel circuit of this embodiment is similar to that of the pixel circuit of the above-mentioned embodiment, except that the process of generating the driving current by the current control sub-circuit is different, and this will not be repeated here.

This embodiment also achieves the technical effects of the above-mentioned embodiments, including that the current control sub-circuit controls the light emitting element L to always work in a high current density region, i.e., a device efficiency stable region, thereby ensuring the light emitting efficiency of the light emitting element L and improving working stability of the light emitting element L. In addition, the light emitting control sub-circuit (including the aforementioned first charging sub-circuit, the second charging sub-circuit, the storage sub-circuit, the first switching sub-circuit and the second switching sub-circuit) controls the light emitting time length of the light emitting element L, thereby accurately and effectively controlling the brightness and gray tone of the light emitting element L.

Figure 16:
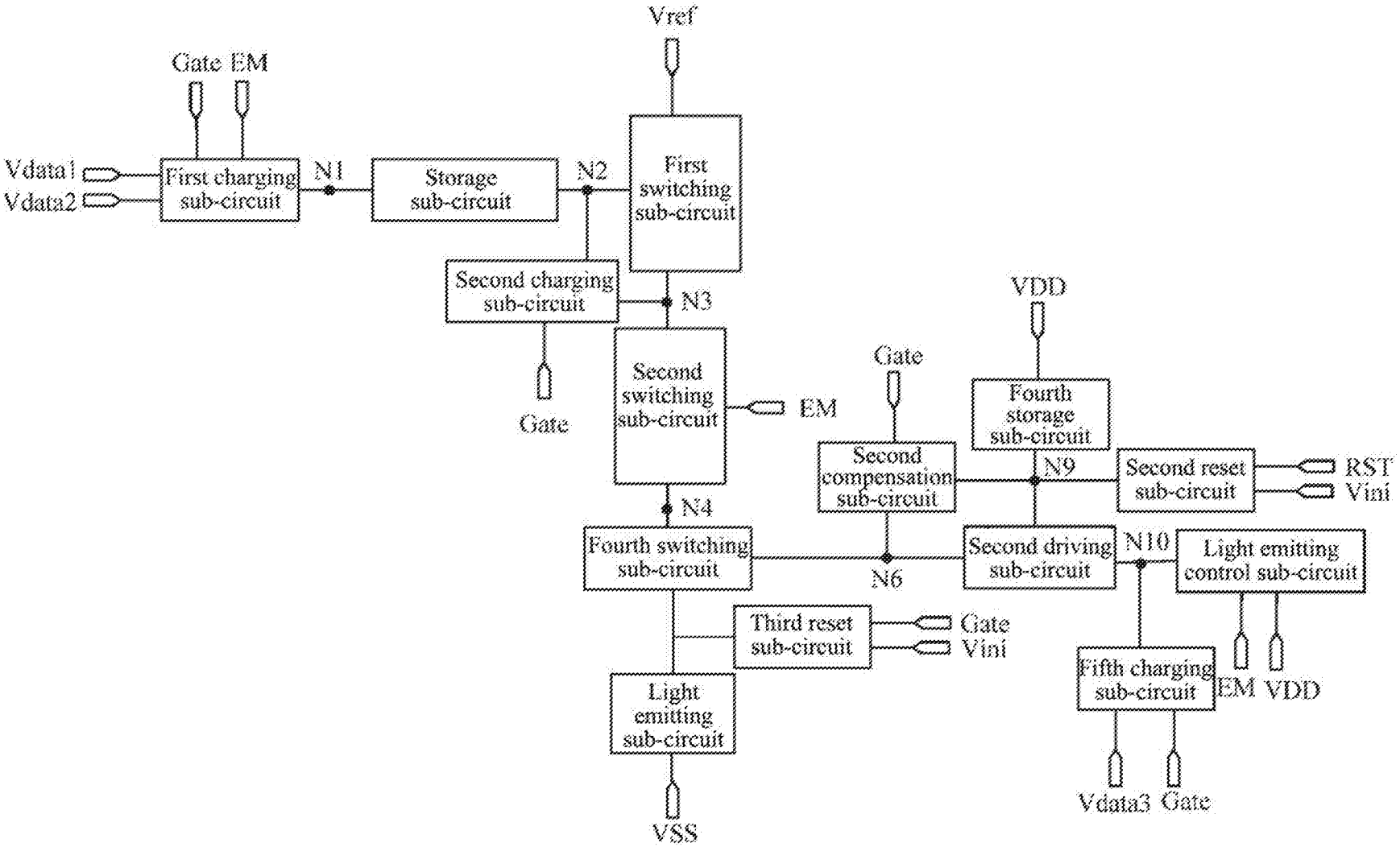
FIG. 16 is a sixth structural diagram of a pixel circuit according to an embodiment of the present disclosure.

An embodiment of the present disclosure further provides a pixel circuit. FIG. 16 is a sixth structural diagram of the pixel circuit according to an embodiment of the present disclosure. This embodiment is an extension of the above embodiments. The main structure of this embodiment is basically the same as those of the above embodiments of the present disclosure, except that the first switching sub-circuit of this embodiment is connected with the third voltage terminal Vref, the second node N2 and the third node N3, respectively, and is configured to provide a signal of the third voltage terminal Vref to the third node N3 under control of the second node N2. For example, a control terminal of the first switching sub-circuit is connected with the second node N2, a first terminal of the first switching sub-circuit is connected with the third voltage terminal Vref, and a second terminal of the first switching sub-circuit is connected with the third node N3. The pixel circuit of this embodiment further includes a current control sub-circuit connected between the fourth node N4 and a terminal of the light emitting sub-circuit. The current control sub-circuit is connected with the scanning signal terminal Gate, the light emitting control terminal EM, the first voltage terminal VDD and the third data signal terminal Vdata3, respectively, and is configured to output a preset current to the light emitting sub-circuit under control of the fourth node N4, the light emitting control terminal EM and the scanning signal terminal Gate. According to an embodiment of the disclosure, the current control sub-circuit controls the light emitting element L in the light emitting sub-circuit to always work in a high current density region, i.e., a device efficiency stable region, thereby ensuring the light emitting efficiency of the light emitting element L and improving working stability of the light emitting element L. In addition, the light emitting control sub-circuit (including the aforementioned first charging sub-circuit, the second charging sub-circuit, the storage sub-circuit, the first switching sub-circuit and the second switching sub-circuit) controls the light emitting time length of the light emitting element L, thereby accurately and effectively controlling the brightness and gray tone of the light emitting element L.

In the following, how to control the light emitting element L to always work in a high current density region through the current control sub-circuit will be explained in detail in combination with the structure of the current control sub-circuit.

FIG. 16 is a sixth structural diagram of a pixel circuit according to an embodiment of the present disclosure. In an exemplary embodiment, as shown in FIG. 16, the current control sub-circuit may include a second reset sub-circuit, a third reset sub-circuit, a light emitting control sub-circuit, a fifth charging sub-circuit, a fourth storage sub-circuit, a second compensation sub-circuit, a second driving sub-circuit, and a fourth switching sub-circuit.

The second reset sub-circuit is connected with the reset control signal terminal RST, the reset voltage terminal Vini and the ninth node N9, respectively, and is configured to write a signal of the reset voltage terminal Vini into the ninth node N9 under control of the reset control signal terminal RST. The third reset sub-circuit is connected with the scanning signal terminal Gate, the reset voltage terminal Vini and an anode of the light emitting element L, respectively, and is configured to write the signal of the reset voltage terminal Vini into the anode of the light emitting element L under control of the scanning signal terminal Gate. The light emitting control sub-circuit is connected with the light emitting control terminal EM, the first voltage terminal VDD and the tenth node N10, respectively, and is configured to provide a signal of the first voltage terminal VDD to the tenth node N10 under control of the light emitting control terminal EM. The fifth charging sub-circuit is connected with the scanning signal terminal Gate, the third data signal terminal Vdata3 and the tenth node N10, respectively, and is configured to provide a signal of the third data signal terminal Vdata3 to the tenth node N10 under control of the scanning signal terminal Gate. The fourth storage sub-circuit is connected with the ninth node N9 and the first voltage terminal VDD, respectively, and is configured to store an amount of charge between the ninth node N9 and the first voltage terminal VDD. The second compensation sub-circuit is connected with the scanning signal terminal Gate, the sixth node N6 and the ninth node N9, respectively, and is configured to compensate a voltage of the ninth node N9 under control of the scanning signal terminal Gate. The second driving sub-circuit is connected with the sixth node N6, the ninth node N9 and the tenth node N10, respectively, and is configured to generate a driving current according to a voltage of the tenth node N10 and output the driving current to the sixth node N6 under control of the ninth node N9. The fourth switching sub-circuit is connected with the sixth node N6, one terminal of the light emitting sub-circuit and the fourth node N4, respectively, and is configured to provide a signal of the sixth node N6 to the light emitting sub-circuit under control of the fourth node N4.

Figure 17:
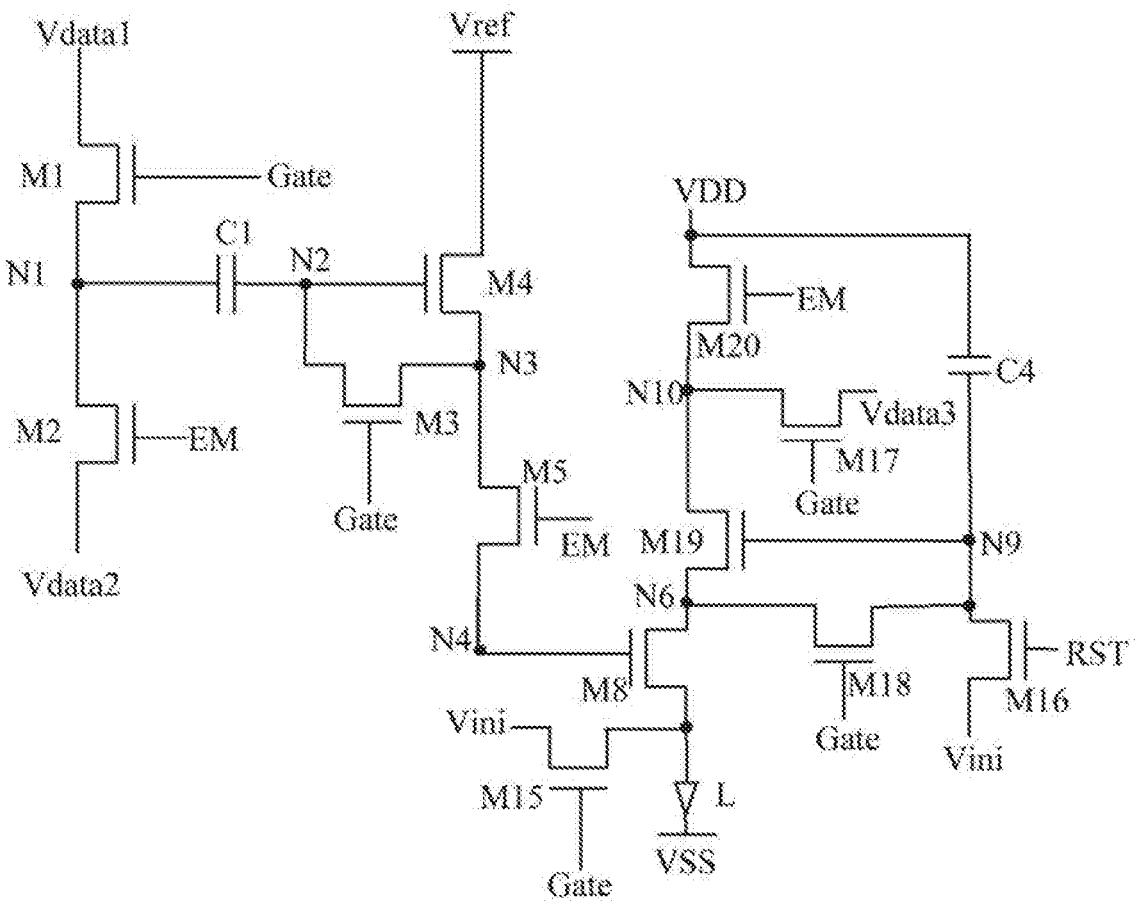
FIG. 17 is a fourth equivalent circuit diagram of a pixel circuit according to an embodiment of the present disclosure.

FIG. 17 is a fourth equivalent circuit diagram of a pixel circuit provided in an embodiment of the disclosure. As shown in FIG. 17, in an exemplary embodiment, a first charging sub-circuit includes a preceding charging sub-circuit and a succeeding charging sub-circuit. The preceding charging sub-circuit includes a first transistor M1, and the succeeding charging sub-circuit includes a second transistor M2. A second charging sub-circuit includes a third transistor M3, a first storage sub-circuit includes a first capacitor C1, a first switching sub-circuit includes a fourth transistor M4, a second switching sub-circuit includes a fifth transistor M5. A fourth switching sub-circuit includes an eighth transistor M8, a second reset sub-circuit includes a fifteenth transistor M15, a third reset sub-circuit includes a sixteenth transistor M16, a fifth charging sub-circuit includes a seventeenth transistor M17, a fourth storage sub-circuit includes a fourth capacitor C4, a second compensation sub-circuit includes an eighteenth transistor M18, a second driving sub-circuit includes a nineteenth transistor M19, the light emitting control sub-circuit includes a twentieth transistor M20, and the light emitting sub-circuit includes a light emitting element L.

A control electrode of the first transistor M1 is connected with the scanning signal terminal Gate, a first electrode of the first transistor M1 is connected with the first data signal terminal Vdata1, and a second electrode of the first transistor M1 is connected with the first node N1. A control electrode of the second transistor M2 is connected with the light emitting control terminal EM, a first electrode of the second transistor M2 is connected with the second data signal terminal Vdata2, and a second electrode of the second transistor M2 is connected with the first node N1. A control electrode of the third transistor M3 is connected with the scanning signal terminal Gate, a first electrode of the third transistor M3 is connected with the second node N2, and a second electrode of the third transistor M3 is connected with the third node N3. One end of the first capacitor C1 is connected with the first node N1, and the other end of the first capacitor C1 is connected with the second node N2. A control electrode of the fourth transistor M4 is connected with the second node N2, a first electrode of the fourth transistor M4 is connected with the third voltage terminal Vref, and a second electrode of the fourth transistor M4 is connected with the third node N3. A control electrode of the fifth transistor M5 is connected with the light emitting control terminal EM, a first electrode of the fifth transistor M5 is connected with the third node N3, and a second electrode of the fifth transistor M5 is connected with the fourth node N4.

A control electrode of the eighth transistor M8 is connected with the fourth node N4, a first electrode of the eighth transistor M8 is connected with the sixth node N6, and a second electrode of the eighth transistor M8 is connected with an anode of the light emitting element L. A control electrode of the fifteenth transistor M15 is connected with the scanning signal terminal Gate, a first electrode of the fifteenth transistor M15 is connected with the reset voltage terminal Vini, and a second electrode of the fifteenth transistor M15 is connected with an anode of the light emitting element L. A control electrode of the sixteenth transistor M16 is connected with the reset control signal terminal RST, a first electrode of the sixteenth transistor M16 is connected with the reset voltage terminal Vini, and a second electrode of the sixteenth transistor M16 is connected with the ninth node N9. A control electrode of the seventeenth transistor M17 is connected with the scanning signal terminal Gate, a first electrode of the seventeenth transistor M17 is connected with the third data signal terminal Vdata3, and a second electrode of the seventeenth transistor M17 is connected with the tenth node N10. A control electrode of the eighteenth transistor M18 is connected with the scanning signal terminal Gate, a first electrode of the eighteenth transistor M18 is connected with the sixth node N6, and a second electrode of the eighteenth transistor M18 is connected with the ninth node N9. A control electrode of the nineteenth transistor M19 is connected with the ninth node N9, a first electrode of the nineteenth transistor M19 is connected with the tenth node N10, and a second electrode of the nineteenth transistor M19 is connected with the sixth node N6. A control electrode of the twentieth transistor M20 is connected with the light emitting control terminal EM, a first electrode of the twentieth transistor M20 is connected with the first voltage terminal VDD, and a second electrode of the twentieth transistor M20 is connected with the tenth node N10. One end of the fourth capacitor C4 is connected with the first voltage terminal VDD, and the other end of the fourth capacitor C4 is connected with the ninth node N9.

FIG. 17 shows an exemplary structure of the preceding charging sub-circuit, the succeeding charging sub-circuit, the second charging sub-circuit, the first storage sub-circuit, the first switching sub-circuit, the second switching sub-circuit, the second reset sub-circuit, the third reset sub-circuit, the fifth charging sub-circuit, the fourth storage sub-circuit, the second compensation sub-circuit, the second driving sub-circuit, the light emitting control sub-circuit, the fourth switching sub-circuit and the light emitting sub-circuit in the pixel circuit. Those skilled in the art may easily understand that implementations of the above various sub-circuits are not limited thereto as long as their respective functions can be realized.

The working process of the pixel circuit of this embodiment is similar to that of the pixel circuit of the above-mentioned embodiment, except that the process of generating the driving current by the current control sub-circuit is different and this will not be repeated here.

This embodiment also achieves the technical effects of the above-mentioned embodiments, including that the current control sub-circuit controls the light emitting element L to always work in a high current density region, i.e., a device efficiency stable region, thereby ensuring the light emitting efficiency of the light emitting element L and improving working stability of the light emitting element L. In addition, the light emitting control sub-circuit (including the aforementioned first charging sub-circuit, the second charging sub-circuit, the storage sub-circuit, the first switching sub-circuit and the second switching sub-circuit) controls the light emitting time length of the light emitting element L, thereby accurately and effectively controlling the brightness and gray tone of the light emitting element L.

An embodiment of the present disclosure further provides a display device including any of the pixel circuits described above. The display device here may be any product or component with a display function such as electronic paper, a mobile phone, a tablet computer, a television, a display, a notebook computer, a digital photo frame, a navigator.

In the description of embodiments of the present disclosure, azimuth or positional relationships indicated by terms "middle", "upper", "lower", "front", "rear", "vertical", "horizontal", "top", "bottom", "inside", "outside" and the like is based on the azimuth or positional relationship shown in the drawings, which is only for ease of description of the present disclosure and simplification of the description, rather than indicating or implying that the device or element referred to must have a specific orientation, or must be constructed and operated in a particular orientation, and therefore they cannot be construed as limiting the present disclosure.

In the description of embodiments of the present disclosure, unless otherwise clearly specified and defined, the terms "install", "connect", "couple" should be broadly interpreted, for example, it may be connected fixedly or connected detachably, or integrated; it may be a mechanical connection or an electrical connection; it may be directly connected, or may be indirectly connected through an intermediary, or may be an internal connection between two elements. Those of ordinary skilled in the art can understand the specific meanings of the above terms in the present disclosure according to specific situations.

Although embodiments of the present disclosure are described in the above, the above embodiments are described only for better understanding, rather than restricting the present disclosure. Any person skilled in the art can make any modifications and variations in modes and details of implementation without departing from the spirit and scope of the present disclosure. However, the protection scope of the present disclosure shall be determined by the scope as defined in the claims.

What we claim is:

1. A pixel circuit, comprising a first charging sub-circuit, a second charging sub-circuit, a first storage sub-circuit, a first switching sub-circuit, a second switching sub-circuit and a light emitting sub-circuit, wherein:

the first charging sub-circuit is connected with a first node, a scanning signal terminal, a light emitting control terminal, a first data signal terminal and a second data signal terminal, respectively, and is configured to provide a signal of the first data signal terminal to the first node under control of the scanning signal terminal, and after providing the signal of the first data signal terminal, provide a signal of the second data signal terminal to the first node under control of the light emitting control terminal;

the second charging sub-circuit is connected with the scanning signal terminal, a second node and a third node, respectively, and is configured to compensate the second node under the control of the scanning signal terminal;

the first storage sub-circuit is connected with the first node and the second node, respectively;

the first switching sub-circuit is connected with the second node and the third node, respectively, and is configured to control a potential of the third node under control of the second node;

the second switching sub-circuit is connected with the third node, the light emitting control terminal and a fourth node, respectively, and is configured to provide a signal of the third node to the fourth node under the control of the light emitting control terminal; and a terminal of the light emitting sub-circuit is connected with the fourth node, and another terminal of the light emitting sub-circuit is connected with a second voltage terminal, wherein the signal of the second data signal terminal is a signal having a time-varying amplitude, used for controlling the first switching sub-circuit to be turned on or turned off with time.

2. The pixel circuit according to claim 1, wherein the first charging sub-circuit comprises a preceding charging sub-circuit and a succeeding charging sub-circuit;

the preceding charging sub-circuit comprises a first transistor, a control electrode of the first transistor is connected with the scanning signal terminal, a first electrode of the first transistor is connected with the first data signal terminal, and a second electrode of the first transistor is connected with the first node; and the succeeding charging sub-circuit comprises a second transistor, a control electrode of the second transistor is connected with the light emitting control terminal, a first electrode of the second transistor is connected with the second data signal terminal, and a second electrode of the second transistor is connected with the first node.

3. The pixel circuit according to claim 1, wherein the light emitting sub-circuit comprises a micro light emitting diode or a mini light emitting diode.

4. The pixel circuit according to claim 1, wherein the second charging sub-circuit comprises: a third transistor, and the first storage sub-circuit comprises a first capacitor;

a control electrode of the third transistor is connected with the scanning signal terminal, a first electrode of the third transistor is connected with the second node, and a second electrode of the third transistor is connected with the third node; and an end of the first capacitor is connected with the first node, and another end of the first capacitor is connected with the second node.

5. The pixel circuit according to claim 1, wherein the first switching sub-circuit comprises a fourth transistor, and the second switching sub-circuit comprises a fifth transistor;

a control electrode of the fourth transistor is connected with the second node, a first electrode of the fourth transistor is connected with a first voltage terminal, and a second electrode of the fourth transistor is connected with the third node; and a control electrode of the fifth transistor is connected with the light emitting control terminal, a first electrode of the fifth transistor is connected with the third node, and a second electrode of the fifth transistor is connected with the fourth node.

6. The pixel circuit according to claim 1, wherein the pixel circuit further comprises a current control sub-circuit, the current control sub-circuit is connected between the fourth node and the light emitting sub-circuit, the current control sub-circuit is connected with the scanning signal terminal, a first voltage terminal and a third data signal terminal, respectively, and is configured to output a preset current to the light emitting sub-circuit under control of the fourth node and the scanning signal terminal.

7. The pixel circuit according to claim 6, wherein the current control sub-circuit comprises a third charging sub-circuit, a second storage sub-circuit, a third switching sub-circuit and a fourth switching sub-circuit;

the third charging sub-circuit is connected with the third data signal terminal, the scanning signal terminal and a fifth node, respectively, and is configured to provide a signal of the third data signal terminal to the fifth node under the control of the scanning signal terminal;

the second storage sub-circuit is connected with the fifth node and the first voltage terminal, respectively;

the third switching sub-circuit is connected with the fifth node, the first voltage terminal and a sixth node, respectively, and is configured to provide a signal of the first voltage terminal to the sixth node under control of the fifth node; and the fourth switching sub-circuit is connected with the sixth node, a terminal of the light emitting sub-circuit and the fourth node, respectively, and is configured to provide a signal of the sixth node to the light emitting sub-circuit under control of the fourth node.

8. The pixel circuit according to claim 7, wherein the third charging sub-circuit comprises: a sixth transistor, the second storage sub-circuit comprises a second capacitor, the third switching sub-circuit comprises a seventh transistor, and the fourth switching sub-circuit comprises an eighth transistor;

a control electrode of the sixth transistor is connected with the scanning signal terminal, a first electrode of the sixth transistor is connected with the third data signal terminal, and a second electrode of the sixth transistor is connected with the fifth node;

an end of the second capacitor is connected with the fifth node, and another end of the second capacitor is connected with the first voltage terminal;

a control electrode of the seventh transistor is connected with the fifth node, a first electrode of the seventh transistor is connected with the first voltage terminal, and a second electrode of the seventh transistor is connected with the sixth node; and a control electrode of the eighth transistor is connected with the fourth node, a first electrode of the eighth transistor is connected with the sixth node, and a second electrode of the eighth transistor is connected with a terminal of the light emitting sub-circuit.

9. The pixel circuit according to claim 7, wherein the current control sub-circuit comprises a second reset sub-circuit, a third reset sub-circuit, a light emitting control sub-circuit, a fifth charging sub-circuit, a fourth storage sub-circuit, a second compensation sub-circuit, a second driving sub-circuit, and a fourth switching sub-circuit;

the second reset sub-circuit is connected with a reset control signal terminal, a reset voltage terminal and a ninth node, respectively, and is configured to write a signal of the reset voltage terminal into the ninth node under control of the reset control signal terminal;

the third reset sub-circuit is connected with the scanning signal terminal, the reset voltage terminal and a terminal of the light emitting sub-circuit, respectively, and is configured to write a signal of the reset voltage terminal into the light emitting sub-circuit under the control of the scanning signal terminal;

the light emitting control sub-circuit is connected with the light emitting control terminal, the first voltage terminal and a tenth node, respectively, and is configured to provide a signal of the first voltage terminal to the tenth node under control of the light emitting control terminal;

the fifth charging sub-circuit is connected with the scanning signal terminal, the third data signal terminal and a tenth node, respectively, and is configured to provide a signal of the third data signal terminal to the tenth node under the control of the scanning signal terminal;

the fourth storage sub-circuit is connected with the ninth node and the first voltage terminal, respectively;

the second compensation sub-circuit is connected with the scanning signal terminal, the sixth node and the ninth node, respectively, and is configured to compensate a voltage of the ninth node under the control of the scanning signal terminal;

the second driving sub-circuit is connected with the sixth node, the ninth node and the tenth node, respectively, and is configured to generate a driving current according to a voltage of the tenth node and output the driving current to the sixth node under control of the ninth node; and the fourth switching sub-circuit is connected with the sixth node, a terminal of the light emitting sub-circuit and the fourth node, respectively, and is configured to provide a signal of the sixth node to the light emitting sub-circuit under control of the fourth node.

10. The pixel circuit according to claim 9, wherein the fourth switching sub-circuit comprises an eighth transistor, the second reset sub-circuit comprises a fifteenth transistor, the third reset sub-circuit comprises a sixteenth transistor, the fifth charging sub-circuit comprises a seventeenth transistor, the fourth storage sub-circuit comprises a fourth capacitor, the second compensation sub-circuit comprises an eighteenth transistor, the second driving sub-circuit comprises a nineteenth transistor, and the light emitting control sub-circuit comprises a twentieth transistor;

a control electrode of the eighth transistor is connected with the fourth node, a first electrode of the eighth transistor is connected with the sixth node, and a second electrode of the eighth transistor is connected with a terminal of the light emitting sub-circuit;

a control electrode of the fifteenth transistor is connected with the scanning signal terminal, a first electrode of the fifteenth transistor is connected with the reset voltage terminal, and a second electrode of the fifteenth transistor is connected with a terminal of the light emitting sub-circuit;

a control electrode of the sixteenth transistor is connected with the reset control signal terminal, a first electrode of the sixteenth transistor is connected with the reset voltage terminal, and a second electrode of the sixteenth transistor is connected with the ninth node;

a control electrode of the seventeenth transistor is connected with the scanning signal terminal, a first electrode of the seventeenth transistor is connected with the third data signal terminal, and a second electrode of the seventeenth transistor is connected with the tenth node;

a control electrode of the eighteenth transistor is connected with the scanning signal terminal, a first electrode of the eighteenth transistor is connected with the sixth node, and a second electrode of the eighteenth transistor is connected with the ninth node;

a control electrode of the nineteenth transistor is connected with the ninth node, a first electrode of the nineteenth transistor is connected with a tenth node, and a second electrode of the nineteenth transistor is connected with the sixth node;

a control electrode of the twentieth transistor is connected with the light emitting control terminal, a first electrode of the twentieth transistor is connected with the first voltage terminal, and a second electrode of the twentieth transistor is connected with the tenth node; and an end of the fourth capacitor is connected with the first voltage terminal, and another end of the fourth capacitor is connected with the ninth node.

11. The pixel circuit according to claim 6, wherein the current control sub-circuit comprises a first reset sub-circuit, a fourth charging sub-circuit, a third storage sub-circuit, a first compensation sub-circuit, a first driving sub-circuit and a fourth switching sub-circuit;

the first reset sub-circuit is connected with a reset control signal terminal, a reset voltage terminal and a seventh node, respectively, and is configured to write a signal of the reset voltage terminal into the seventh node under control of the reset control signal terminal;

the fourth charging sub-circuit is connected with the scanning signal terminal, the third data signal terminal and an eighth node, respectively, and is configured to provide a signal of the third data signal terminal to the eighth node under the control of the scanning signal terminal;

the third storage sub-circuit is connected with the seventh node and the eighth node, respectively;

the first compensation sub-circuit is connected with the scanning signal terminal, the sixth node and the seventh node, respectively, and is configured to compensate a voltage of the seventh node under the control of the scanning signal terminal;

the first driving sub-circuit is connected with the sixth node, the seventh node and the first voltage terminal, respectively, and is configured to generate a driving current according to a voltage of the first voltage terminal and output the driving current to the sixth node under control of the seventh node; and the fourth switching sub-circuit is connected with the sixth node, a terminal of the light emitting sub-circuit and the fourth node, respectively, and is configured to provide a signal of the sixth node to the light emitting sub-circuit under control of the fourth node.

12. The pixel circuit according to claim 11, wherein the fourth switching sub-circuit comprises an eighth transistor, the first reset sub-circuit comprises a ninth transistor, the fourth charging sub-circuit comprises a tenth transistor, an eleventh transistor and a twelfth transistor, the third storage sub-circuit comprises a third capacitor, the first compensation sub-circuit comprises a thirteenth transistor, and the first driving sub-circuit comprises a fourteenth transistor;

a control electrode of the eighth transistor is connected with the fourth node, a first electrode of the eighth transistor is connected with the sixth node, and a second electrode of the eighth transistor is connected with a terminal of the light emitting sub-circuit;

a control electrode of the ninth transistor is connected with the reset control signal terminal, a first electrode of the ninth transistor is connected with the reset voltage terminal, and a second electrode of the ninth transistor is connected with the seventh node;

a control electrode of the tenth transistor is connected with the scanning signal terminal, a first electrode of the tenth transistor is connected with the third data signal terminal, and a second electrode of the tenth transistor is connected with the eighth node;

a control electrode of the eleventh transistor is connected with the light emitting control terminal, a first electrode of the eleventh transistor is connected with the second voltage terminal, and a second electrode of the eleventh transistor is connected with the eighth node;

a control electrode of the twelfth transistor is connected with the reset control signal terminal, a first electrode of the twelfth transistor is connected with the second voltage terminal, and a second electrode of the twelfth transistor is connected with the eighth node;

an end of the third capacitor is connected with the seventh node, and another end of the third capacitor is connected with the eighth node;

a control electrode of the thirteenth transistor is connected with the scanning signal terminal, a first electrode of the thirteenth transistor is connected with the sixth node, and a second electrode of the thirteenth transistor is connected with the seventh node; and a control electrode of the fourteenth transistor is connected with the seventh node, a first electrode of the fourteenth transistor is connected with the first voltage terminal, and a second electrode of the fourteenth transistor is connected with the sixth node.

13. A display device, comprising a pixel circuit, the pixel circuit comprising a first charging sub-circuit, a second charging sub-circuit, a first storage sub-circuit, a first switching sub-circuit, a second switching sub-circuit and a light emitting sub-circuit, wherein:

the first charging sub-circuit is connected with a first node, a scanning signal terminal, a light emitting control terminal, a first data signal terminal and a second data signal terminal, respectively, and is configured to provide a signal of the first data signal terminal to the first node under control of the scanning signal terminal, and after providing the signal of the first data signal terminal, to provide a signal of the second data signal terminal to the first node under control of the light emitting control terminal;

the second charging sub-circuit is connected with the scanning signal terminal, a second node and a third node, respectively, and is configured to compensate the second node under the control of the scanning signal terminal;

the first storage sub-circuit is connected with the first node and the second node, respectively;

the first switching sub-circuit is connected with the second node and the third node, respectively, and is configured to control a potential of the third node under control of the second node;

the second switching sub-circuit is connected with the third node, the light emitting control terminal and a fourth node, respectively, and is configured to provide a signal of the third node to the fourth node under the control of the light emitting control terminal, and wherein the signal of the second data signal terminal is a signal having a time-varying amplitude, used for controlling the first switching sub-circuit to be turned on or turned off with time.

14. The display device according to claim 13, wherein the pixel circuit further comprises a current control sub-circuit, the current control sub-circuit is connected between the fourth node and the light emitting sub-circuit, the current control sub-circuit is connected with the scanning signal terminal, a first voltage terminal and a third data signal terminal, respectively, and is configured to output a preset current to the light emitting sub-circuit under control of the fourth node and the scanning signal terminal.

15. The display device according to claim 14, wherein the current control sub-circuit comprises a third charging sub-circuit, a second storage sub-circuit, a third switching sub-circuit and a fourth switching sub-circuit;

the third charging sub-circuit is connected with the third data signal terminal, the scanning signal terminal and a fifth node, respectively, and is configured to provide a signal of the third data signal terminal to the fifth node under the control of the scanning signal terminal;

the second storage sub-circuit is connected with the fifth node and the first voltage terminal, respectively;

the third switching sub-circuit is connected with the fifth node, the first voltage terminal and a sixth node, respectively, and is configured to provide a signal of the first voltage terminal to the sixth node under control of the fifth node; and the fourth switching sub-circuit is connected with the sixth node, a terminal of the light emitting sub-circuit and the fourth node, respectively, and is configured to provide a signal of the sixth node to the light emitting sub-circuit under control of the fourth node.

16. The display device according to claim 14, wherein the current control sub-circuit comprises a second reset sub-circuit, a third reset sub-circuit, a light emitting control sub-circuit, a fifth charging sub-circuit, a fourth storage sub-circuit, a second compensation sub-circuit, a second driving sub-circuit, and a fourth switching sub-circuit;

the second reset sub-circuit is connected with a reset control signal terminal, a reset voltage terminal and a ninth node, respectively, and is configured to write a signal of the reset voltage terminal into the ninth node under control of the reset control signal terminal;

the third reset sub-circuit is connected with the scanning signal terminal, the reset voltage terminal and a terminal of the light emitting sub-circuit, respectively, and is configured to write a signal of the reset voltage terminal into the light emitting sub-circuit under the control of the scanning signal terminal;

the light emitting control sub-circuit is connected with the light emitting control terminal, the first voltage terminal and a tenth node, respectively, and is configured to provide a signal of the first voltage terminal to the tenth node under control of the light emitting control terminal;

the fifth charging sub-circuit is connected with the scanning signal terminal, the third data signal terminal and a tenth node, respectively, and is configured to provide a signal of the third data signal terminal to the tenth node under the control of the scanning signal terminal;

the fourth storage sub-circuit is connected with the ninth node and the first voltage terminal, respectively;

the second compensation sub-circuit is connected with the scanning signal terminal, the sixth node and the ninth node, respectively, and is configured to compensate a voltage of the ninth node under the control of the scanning signal terminal;

the second driving sub-circuit is connected with the sixth node, the ninth node and the tenth node, respectively, and is configured to generate a driving current according to a voltage of the tenth node and output the driving current to the sixth node under control of the ninth node; and the fourth switching sub-circuit is connected with the sixth node, a terminal of the light emitting sub-circuit and the fourth node, respectively, and is configured to provide a signal of the sixth node to the light emitting sub-circuit under control of the fourth node.

17. A method for driving a pixel circuit, the pixel circuit having a plurality of scanning periods; in a scanning period, the method comprising:

providing a first voltage to a first voltage terminal, providing a scanning signal to a scanning signal terminal, providing a first data voltage to the first data signal terminal, writing the first data voltage to a first node through a first charging sub-circuit, and compensating a second node by a second charging sub-circuit under control of the scanning signal terminal;

providing a light emitting control signal to a light emitting control terminal and providing a second data voltage to a second data signal terminal, wherein the second data voltage is a voltage having a time-varying amplitude, writing the second data voltage to the first node through the first charging sub-circuit, a voltage of the second node jumping with time along with a voltage of the first node to control a first switching sub-circuit to be turned on or turned off with time, and emitting light by a light emitting sub-circuit under control of the first switching sub-circuit and a second switching sub-circuit.

18. The method for driving a pixel circuit according to claim 17, wherein before providing the light emitting control signal to the light emitting control terminal, the method further comprises:

providing a third data voltage to a third data signal terminal, and generating a driving current with a preset current density by a current control sub-circuit based on the first voltage and the third data voltage under control of the scanning signal terminal.

* * * * *